US008840099B2

(12) United States Patent
Masunari et al.

(10) Patent No.: US 8,840,099 B2
(45) Date of Patent: Sep. 23, 2014

(54) BINDING APPARATUS

(75) Inventors: Kazushige Masunari, Tokyo (JP); Yumiko Kato, Tokyo (JP); Kuniaki Kimura, Tokyo (JP); Hiroshi Tsuchiya, Tokyo (JP)

(73) Assignee: Gradco Japan Ltd., Tokyo (JP)

( * ) Notice: Subject to any disclaimer, the term of this patent is extended or adjusted under 35 U.S.C. 154(b) by 355 days.

(21) Appl. No.: 13/326,442

(22) Filed: Dec. 15, 2011

(65) Prior Publication Data

US 2012/0155993 A1 Jun. 21, 2012

(30) Foreign Application Priority Data

Dec. 16, 2010 (JP) ..... 2010-280726
Dec. 16, 2010 (JP) ..... 2010-280731
Sep. 30, 2011 (JP) ..... 2011-217549

(51) Int. Cl.

| | |
|---|---|
| ***B42C 9/00*** | (2006.01) |
| ***B31F 5/06*** | (2006.01) |
| *B42C 5/04* | (2006.01) |
| *B42C 19/04* | (2006.01) |
| *B42D 3/00* | (2006.01) |

(52) U.S. Cl.

CPC ..... *B42C 9/0056* (2013.01); *B31F 5/06* (2013.01); *B42C 5/04* (2013.01); *B42C 9/0068* (2013.01); *B42C 19/04* (2013.01); *B42D 3/002* (2013.01)

USPC ..... 270/58.08; 270/58.07; 270/58.11; 412/8; 412/33; 412/37

(58) Field of Classification Search

CPC ..... B31F 5/06; B31F 5/08; B65H 37/02; B65H 37/04; B42C 5/04; B42C 9/00; B42C 9/02

USPC ..... 270/58.07, 58.08, 58.11, 58.12; 412/8, 412/33, 37

See application file for complete search history.

(56) References Cited

U.S. PATENT DOCUMENTS

| | | | | |
|---|---|---|---|---|
| 4,828,645 | A * | 5/1989 | Van Bortel | 156/384 |
| 5,108,244 | A * | 4/1992 | Bellanca | 412/37 |
| 5,569,012 | A * | 10/1996 | Kosasa et al. | 412/33 |
| 5,833,423 | A * | 11/1998 | Yamaguchi et al. | 412/8 |
| 6,641,345 | B2 * | 11/2003 | Cobene et al. | 412/1 |
| 7,048,269 | B2 * | 5/2006 | Hoarau | 270/52.17 |
| 7,490,860 | B2 * | 2/2009 | Didde | 281/40 |
| 8,157,493 | B2 * | 4/2012 | Kim | 412/33 |
| 8,475,106 | B2 * | 7/2013 | Hata | 412/16 |
| 2007/0045928 | A1 * | 3/2007 | Yoshie et al. | 270/58.08 |
| 2008/0219802 | A1 * | 9/2008 | Hata | 412/12 |
| 2009/0148215 | A1 * | 6/2009 | Takahashi et al. | 399/408 |
| 2010/0158638 | A1 * | 6/2010 | Kim | 412/16 |

* cited by examiner

*Primary Examiner* — Leslie A Nicholson, III

(74) *Attorney, Agent, or Firm* — Flynn, Thiel, Boutell & Tanis, P.C.

(57) ABSTRACT

A binding apparatus performs a binding process by bonding the end side of the sheet bundle, and is provided with a notch cutter that forms a notch in the end side used in the sheet binding process in the middle of the sheet conveyance path of the binding apparatus. The notch-forming unit includes a pair of sheet conveyance guides for forming a part of the sheet conveyance path, a cutter provided in a rotatably supported bracket, and a biasing means for applying a force to the cutter to face the sheet conveyance path formed by a pair of the sheet conveyance guides at all times.

14 Claims, 37 Drawing Sheets

(a)

(b)

(c)

(a)

(b)

BINDING APPARATUS

BACKGROUND OF THE INVENTION

1. Field of the Invention

The present invention relates to a binding apparatus that post-processes and binds the sheets discharged from an image-forming apparatus such as a copying machine or a printer.

2. Description of the Related Art

An exemplary typical binding apparatus includes a sheet processing unit having a sheet sorter and a binding conveyor, a sheet conveying unit, a tape feeder unit, a binding unit serving as a sheet post-processing means, and a stacker (refer to Japanese Patent Application Laid-Open (JP-A) No. 8-301504).

In such a binding apparatus, for example, as a sheet bundle is moved to a tape heater unit, a tape is supplied from the tape feeder unit. As the tape is supplied from the tape feeder unit, the sheet bundle is moved to the binding unit, and a binding process for attaching the tape to the rear surface and the side surface of the sheet bundle is performed so that the bound booklet is loaded on the stacker using the binding conveyor.

In addition, as the binding process, there is known an adhesive binding process of integrating the printed sheets into a volume of the sheet bundle. The adhesive binding unit includes a unit for discharging a glue to the sheets using an adhesive discharge nozzle, a unit for installing a glue stick in the glue casing, attaching a glue to the outer circumference of the rotating glue stick, and brining the outer circumference of the glue stick into contact with the sheets to transfer the glue by contact, a hot-melt coating unit for discharging a combination of the hot-melt agent (thermal bonding agent) and the compressed hot air from the nozzle, and a tape attaching unit for attaching the tape to the rear portion of the sheet bundle while heating the tape where the glue having viscosity has been coated in advance.

In such a typical binding apparatus, a plurality of notched trenches are formed in the end side of the sheet bundle using a milling apparatus after the sheet bundle is clamped using a clamp device, and the glue is coated on the end side of the sheet bundle having the notched trenches. In addition, in some binding apparatuses, the notch portion is formed in the end side where the glue is coated in the sheet conveyance path during the sheet binding process (refer to JP-A No. 2007-62145)

In this manner, if a notch portion or a notched trench is formed in the end side of the sheet bundle in order to coat the glue during the sheet binding process, scraps are generated and make the apparatus dirty. Therefore, it is necessary to provide a scrap recovery unit. In addition, a special tool such as a milling apparatus or a puncher is necessary. This increases the size and the cost of the apparatus.

SUMMARY OF THE INVENTION

The present invention has been made to address the aforementioned problems and provide a binding apparatus capable of achieving a binding strength using a simple structure without increasing the size of the binding apparatus by upgrading the binding apparatus.

In order to address the aforementioned problems and achieve the object, the invention is configured as follows.

According to the invention, there is provided a binding apparatus for binding sheets by welding a binding tape on a stitch portion of a sheet bundle, wherein a sheet conveyance path of the binding apparatus includes: a notch forming unit for forming a notch in a stitch portion side where the binding tape is welded to bind sheets; and a binding unit for binding sheets by welding the binding tape to the stitch portion of the sheet bundle obtained by bundling up the sheets having the notch. It is possible to achieve the binding strength using the notch, prevent scraps from being generated or scattered to make the apparatus dirty, and get rid of necessity to provide a scrap recovery unit.

In addition, the binding unit includes a pair of sheet conveyance guides for forming a part of the sheet conveyance path, a cutter provided in a rotatably supported bracket, and a biasing unit that applies a force to the cutter to face the sheet conveyance path formed by a pair of the sheet conveyance guides at all times, a notch is formed when the cutter makes contact with an end side of the conveyed sheet, the bracket is pressedly moved against a biasing force of the biasing unit by conveyance of the sheet having the notch, and the cutter is separated from the sheet. The end side of the conveyed sheet makes contact with the cutter to form the notch, the bracket is pressedly moved against the biasing force of the biasing unit by conveyance of the sheet having the notch, the cutter is separated from the sheet, and the notch is automatically formed by conveyance of the sheet.

In addition, a part of the cutter protrudes from the bracket, and a length of the notch of the sheet is set based on a protruding length of the cutter so that the binding strength can be controlled depending on the sheet type, size, thickness, and the like.

According to the present invention, there is provided a binding apparatus for binding sheets by welding a binding tape to a stitch portion of a sheet bundle, including a switch-back path arranged in a sheet conveyance path of the binding apparatus, wherein a next stage of the switch-back path includes a notch forming unit for forming a notch in a stitch portion side where the binding tape is welded to bind sheets, and a binding unit for binding sheets by welding the binding tape to the stitch portion of the sheet bundle obtained by bundling up the sheets having the notch. For example, in a case where the notch is formed in the end side in the front stage of the conveyance direction of the sheet inserted from the image forming apparatus, the switch-back path is not used. In a case where the notch is formed in the rear stage of the conveyance direction of the sheet inserted from the image-forming apparatus, the switch-back path is used to form the notch in the end side of the sheet. Therefore, it is possible to respond to various image-forming apparatuses.

According to the present invention, the binding unit includes a heater unit for pressing the stitch portion of the sheet bundle by melting an adhesive attached to one surface by applying heat of a predetermined temperature to the binding tape using a heater, a heater shifting unit that moves the heater between a forward movement position and a backward movement position in a straight line, a sheet bundle shifting unit which includes a lower heater clamp and an upper heater clamp for clamping the sheet bundle and vertically moves while the sheet bundle is clamped using the lower and upper heater clamps, and a control unit performs control of the sheet bundle shifting unit such that, in a state that the sheet bundle is clamped using the lower and upper heater clamps, and the binding tape is overlapped with an upper surface of the stitch portion of the sheet bundle, the binding tape is welded to an upper surface of the stitch portion of the sheet bundle using the heater by upwardly moving the sheet bundle to make the binding tape abut on a lower surface of the heater, the heater shifting unit is controlled such that the heater is moved to a side face of the stitch portion of the sheet bundle in a straight line from the forward movement position to the backward movement position, the sheet bundle shifting unit is controlled such that the sheet bundle is lifted, while the sheet bundle is clamped, to weld the binding tape to a side face of the stitch portion of the sheet bundle using the heater, and the sheet bundle is lifted to locate a lower portion of the side face of the stitch portion in an upper portion of the heater, and the heater shifting unit is controlled such that the heater is moved in a straight line from the backward movement position to the forward movement position to weld the binding tape to a lower surface of the stitch portion of the sheet bundle. Using a simple structure in which the sheet bundle is moved in parallel and set, the heater is moved between the forward movement position and the backward movement position in a straight line, the lower and upper heater clamps are provided to clamp the sheet bundle, the sheet bundle is moved in a direction parallel to the heater and a direction perpendicular to the parallel direction while the sheet bundle is clamped using the lower and upper heater clamps, it is possible to prevent ink blurring of the characters printed on the sheet during the tape welding process of the sheet bundle and improve the binding quality.

The binding apparatus further includes a movement distance detection unit that detects a movement distance until the sheet bundle is clamped using the lower and upper heater clamps after the lower heater clamp starts to rise, wherein the control unit controls the sheet bundle shifting unit by obtaining a thickness of the sheet bundle based on the movement distance, and the sheet bundle is moved by a distance depending on the obtained thickness of the sheet bundle. The movement distance until the sheet bundle is clamped using the lower and upper heater clamps after the lower heater clamp starts to rise is detected, the thickness of the sheet bundle is obtained based on the movement distance, and the sheet bundle is lifted vertically by a distance depending on the thickness of the sheet bundle so that the sheet bundle can be vertically moved depending on the actual thickness of the sheet bundle.

The binding apparatus further includes: a tape guide unit for receiving and holding a supplied binding tape; and a tape guide unit shifting mechanism that moves the tape guide unit between a receiving position and an attaching position, wherein the control unit controls the tape guide unit shifting mechanism to move the tape guide unit, the supplied binding tape is received and held at the receiving position, the binding tape is welded to an upper surface of the stitch portion of the sheet bundle using the heater at the attaching position, and the tape guide unit is recovered to the receiving position after binding tape is welded to the upper surface of the stitch portion of the sheet bundle. At the receiving position, the supplied binding tape is received, held, and moved. At the attaching position, the binding tape is welded to the upper surface of the stitch portion of the sheet bundle using the heater. The tape guide unit is recovered to the receiving position after the binding tape is welded to the upper surface of the stitch portion of the sheet bundle. As a result, it is possible to reliably weld the binding tape to the stitch portion of the sheet bundle.

The binding apparatus further includes a guide plate which abuts on the upper surface of the heater to guide a movement of the heater. Since the guide plate guides the movement of the heater in the horizontal direction, it is possible to accurately perform the heater movement and simplify the shifting structure.

According to the present invention, the binding unit includes a heater unit for applying heat of a predetermined temperature to the binding tape to melt an adhesive attached on one surface thereof and press an end face of the sheet bundle, a tape guide unit for receiving the supplied binding tape, a tape guide unit driving mechanism that moves the tape guide unit between a receiving position where the supplied binding tape is received and a pressing position of the heater unit, a tape removing unit that removes the binding tape inappropriately received by the tape guide unit from the tape guide unit, a informing unit that notifies the inappropriate receiving and instructing a removal manipulation in the tape removing unit, a tape receiving-state determining unit that determines a receiving state of the binding tape in the tape guide unit, and a control unit that performs control such that, if the tape receiving-state determining unit determines that the receiving state is appropriate, the tape guide unit driving mechanism is controlled such that the tape guide unit is moved from a receiving position where the binding tape is received to a pressing position of the heater unit, and if the tape receiving-state determining unit determines that the receiving state is inappropriate, the informing unit notifies the inappropriate receiving to instruct a removal manipulation in the tape removing unit. If the tape receiving-state determining unit determines that the receiving state is appropriate, the tape guide unit is moved from the receiving position for receiving the binding tape to the pressing position of the heater unit. If the tape receiving-state determining unit determines that the receiving state is inappropriate, the binding tape suffering from the inappropriate receiving in the receiving position is removed from the tape guide unit. Therefore, it is possible to remove the binding tape suffering from the inappropriate receiving without being affected from the heat when a binding tape supply error such as a jam occurs.

The binding apparatus further includes a tape detection sensor for detecting supply of the binding tape, wherein the tape receiving-state determining unit determines that the receiving state is appropriate if the tape detection sensor detects a leading end of the binding tape and detects a trailing end within an defined time, and the tape receiving-state determining unit determines that the receiving state is inappropriate if the tape detection sensor detects a leading end of the binding tape and does not detect a trailing end within an defined time. If the tape detection sensor detects the trailing end within a defined time after detecting the leading end of the binding tape, it is determined that the receiving state is appropriate. If the tape detection sensor does not detect the trailing end within a defined time after detecting the leading end of the binding tape, it is determined that the receiving state is inappropriate. Therefore, it is possible to reliably and simply determine the receiving state of the binding tape.

The tape guide unit includes a tape transport path for holding the supplied binding tape, the tape removing unit includes a notch portion formed to cross the tape transport path and a push member having a rotation lever enabled to move forward and backward within the notch portion, and the rotation lever is operated to enter a gap within the notch portion to remove the binding tape from the tape transport path if it is determined that the receiving state is inappropriate. If it is determined that the receiving state is inappropriate, the rotation lever is operated to enter a gap within the notch portions. Therefore, it is possible to conveniently remove the binding tape from the tape transport path.

If it is determined that the receiving state is inappropriate, the control unit performs control such that a warning unit that warns that the receiving state is inappropriate is operated, an error occurrence signal is transmitted to an image-forming apparatus that forms an image on the sheet of the sheet bundle, and the image-forming apparatus receives the error occurrence signal and stops operations of the image-forming apparatus and the binding apparatus. If it is determined that the receiving state is inappropriate, a warning unit that warns that the receiving state is inappropriate is operated to notify that the receiving state is inappropriate and stop the operation of the image-forming apparatus for forming an image on the sheet of the sheet bundle and the operation of the binding apparatus. Therefore, it is possible to alleviate the effect of the apparatus to the entire system.

The binding apparatus further includes a tape conveying unit that conveys the binding tape, wherein the control unit controls the tape conveying unit such that the binding tape is conveyed and supplied to the tape guide unit at a predetermined timing if it is determined that the receiving state is appropriate, and conveyance of the binding tape stops if it is determined that the receiving state is inappropriate. If it is determined that the receiving state is inappropriate, a warning unit that warns that the receiving state is inappropriate is operated to notify that the receiving state is inappropriate, and the operation of the image-forming apparatus for forming an image on the sheet of the sheet bundle and the operation of the binding apparatus stop. Therefore, it is possible to alleviate the effect of the apparatus to the entire system.

DETAILED DESCRIPTION OF THE PREFERRED EMBODIMENTS

Hereinafter, a binding apparatus according to an embodiment of the invention will be described. The embodiment of the invention exemplifies a preferable mode of the invention, but the invention is not limited thereto.

First Embodiment (Entire Configuration of Binding Apparatus)

Figure 1:
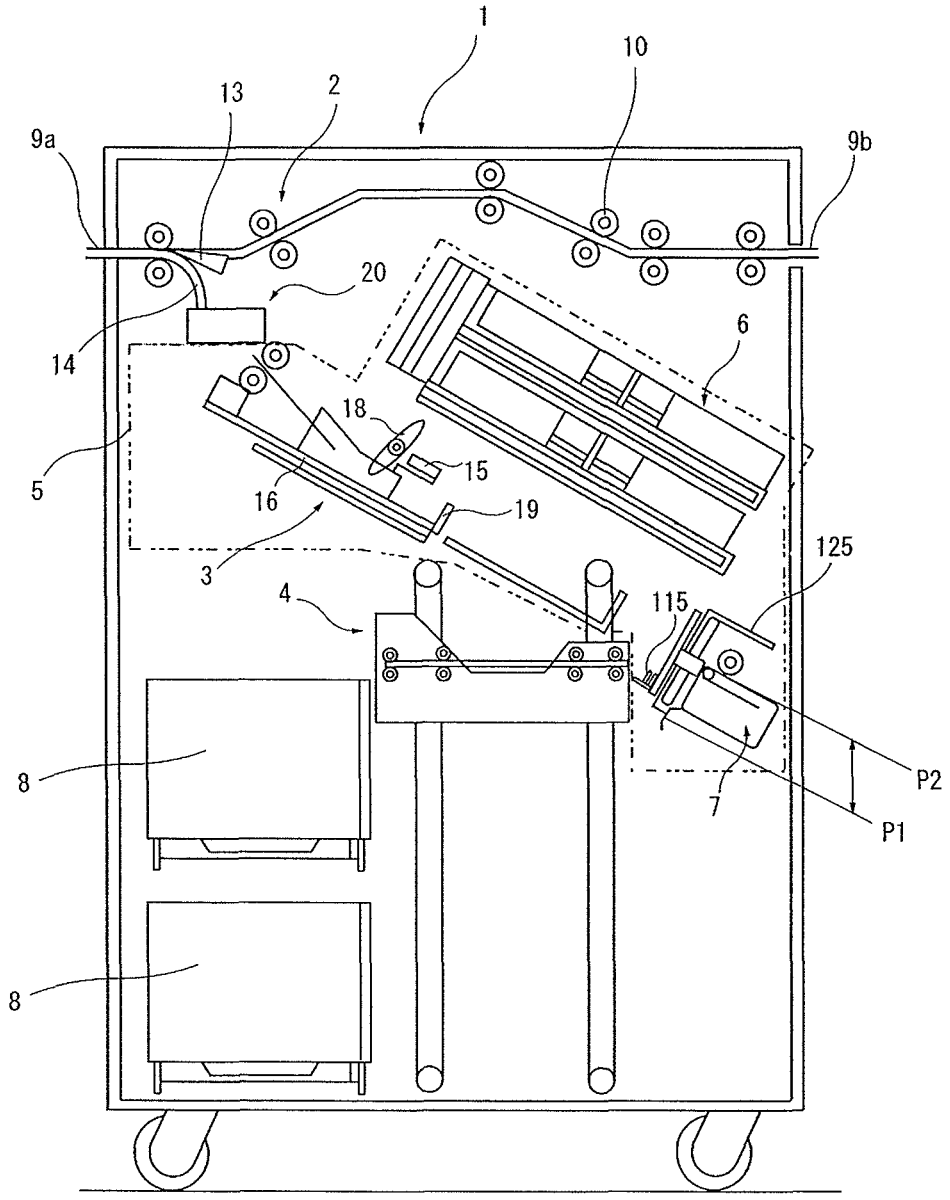
FIG. 1 is a schematic diagram illustrating the configuration of the entire binding apparatus according to a first embodiment.

A binding apparatus according to the present embodiment is illustrated in FIG. 1, which is a schematic diagram of the entire configuration of the binding apparatus.

The binding apparatus 1 includes a sheet-processing unit 5 having a sheet aligner 3, a tape feeder unit 6, and a binding unit 7, a sheet-conveying unit 2, a binding conveyor 4, and a stacker 8.

The sheet-conveying unit 2 has a sheet inlet 9*a* and a sheet outlet 9*b*, and a plural set of rollers 10 are provided between the sheet inlet 9*a* and the sheet outlet 9*b*. A sorting guide 13 is provided in the vicinity of the sheet inlet 9*a* so that the sheet is sorted and moved to the sheet conveyance path 14 at the time of binding. The sheet sorted to the sheet conveyance path 14 by the sorting guide 13 is inserted into the sheet aligner 3 of the sheet processing unit 5.

The sheet aligner 3 includes a tray 16 where the sheets are loaded, an alignment pedal 18 for aligning the inserted sheets, a rotation stopper 19 where the inserted sheets are aligned and stay temporarily, and a sheet clamp 15 for clamping the sheets aligned in the rotation stopper 19 and delivering the sheets to the binding unit 7. The rotation stopper 19 and the sheet clamp 15 clamp and move the sheet bundle loaded on the tray 16 to the binding unit 7. As the sheet bundle is moved to the binding unit 7, the tape is supplied from the tape feeder unit 6, and a binding process is performed such that the tape is attached to the rear surface and the side surface of the sheet bundle end. Then, the bound booklet is loaded on the stacker 8 through the binding conveyor 4.

The binding apparatus 1 performs the binding process by bonding the end side of the sheet bundle, and a notch cutter 20 for forming a notch in the end side used in the sheet binding process is provided in the middle of the sheet conveyance path of the binding apparatus 1. The notch cutter 20 is arranged in the sheet conveyance path 14 in front of the sheet aligner 3.

(Configuration of Notch Cutter)

Figure 2:
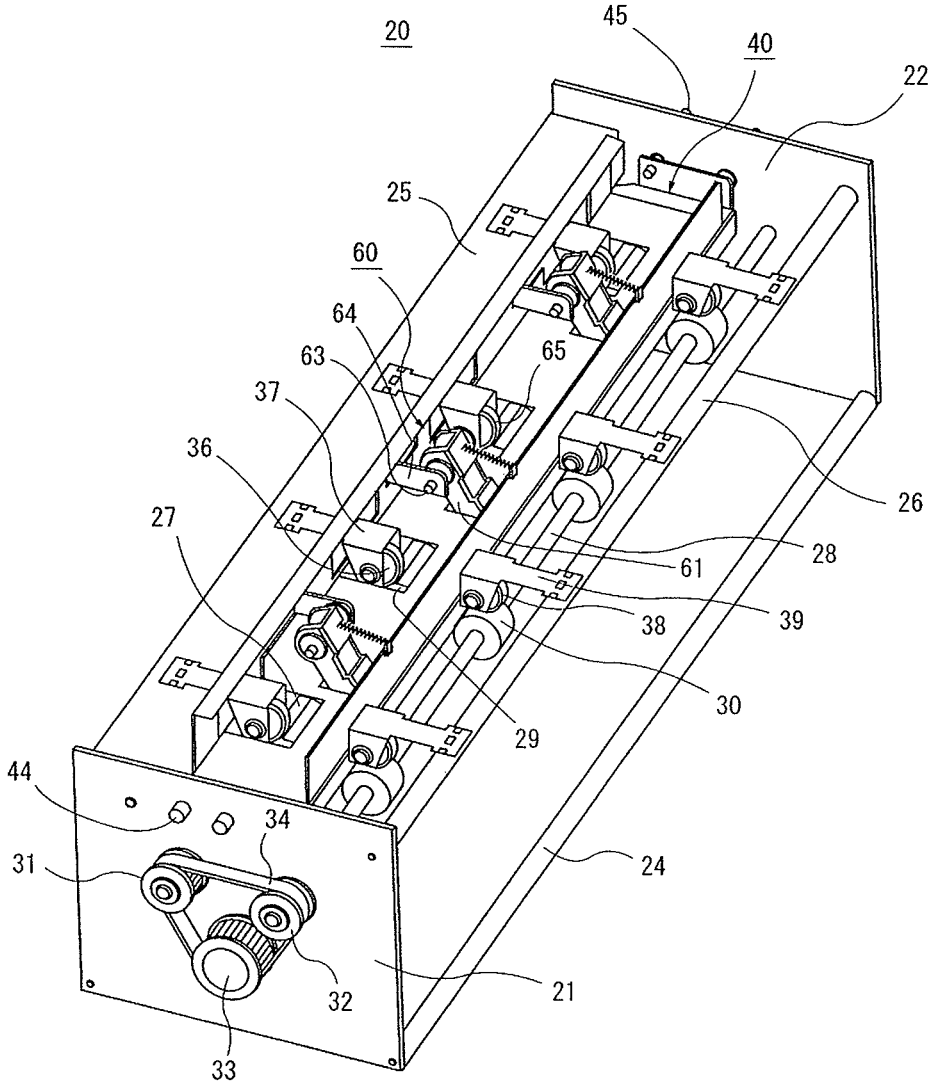
FIG. 2 is a perspective view illustrating a notch cutter.
Figure 3:
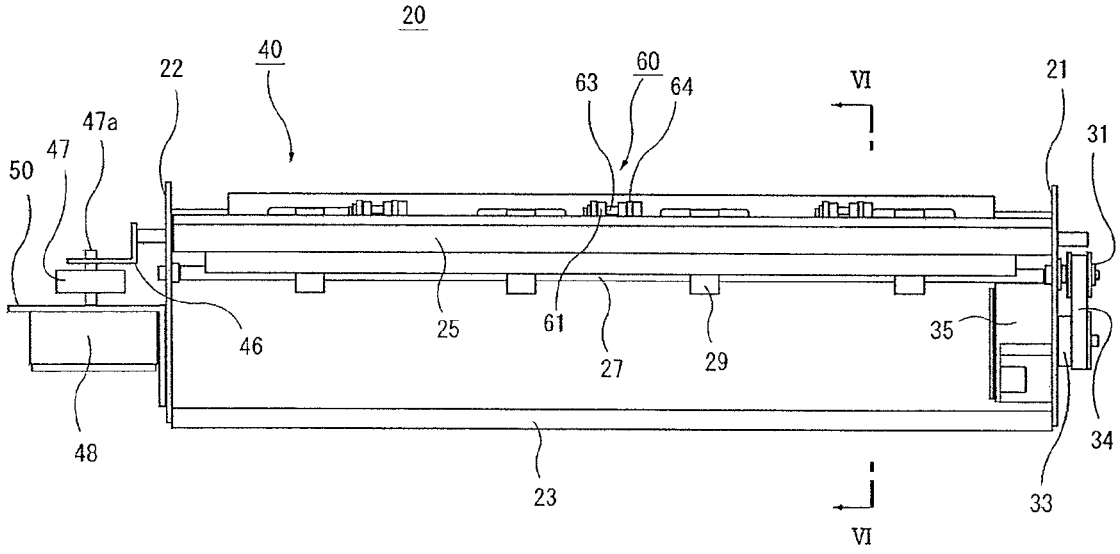
FIG. 3 is a front view illustrating the notch cutter.
Figure 4:
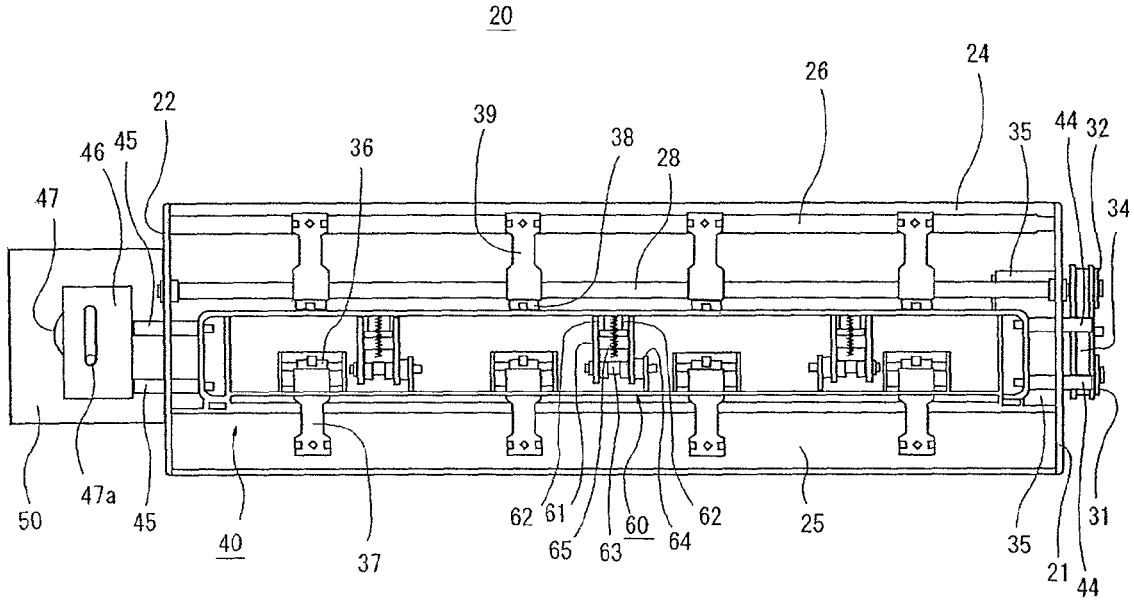
FIG. 4 is a plan view illustrating the notch cutter.
Figure 5:
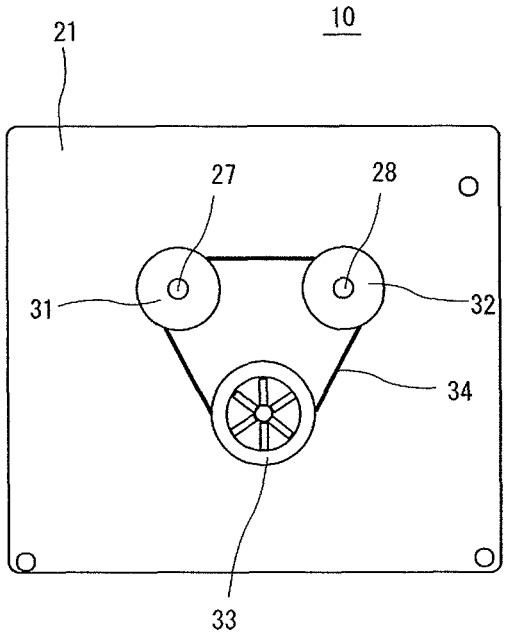
FIG. 5 is a right-side view illustrating the notch cutter.
Figure 6:
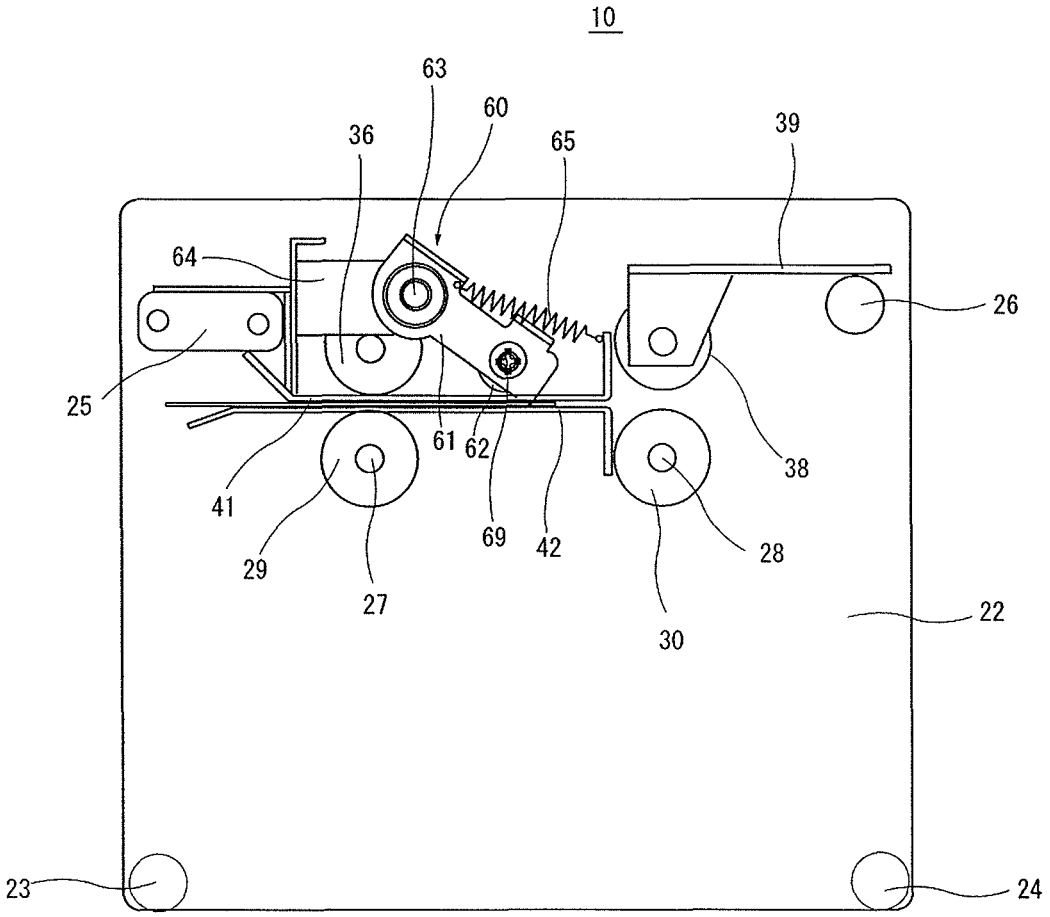
FIG. 6 is a cross-sectional view taken along the line VI-VI of FIG. 3.
Figure 7:
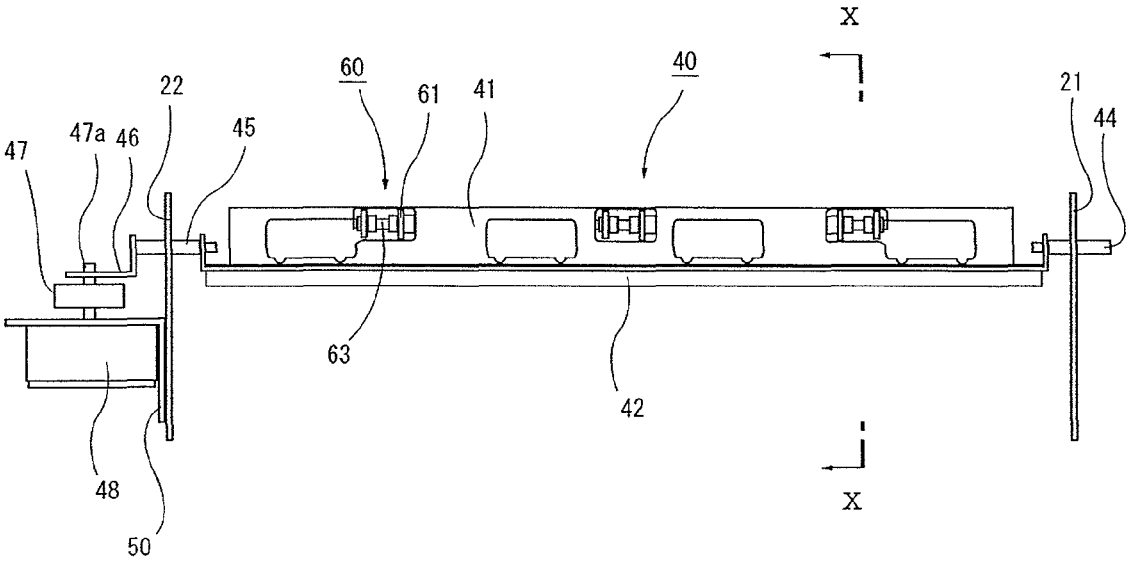
FIG. 7 is a front view illustrating a shifting unit.
Figure 8:
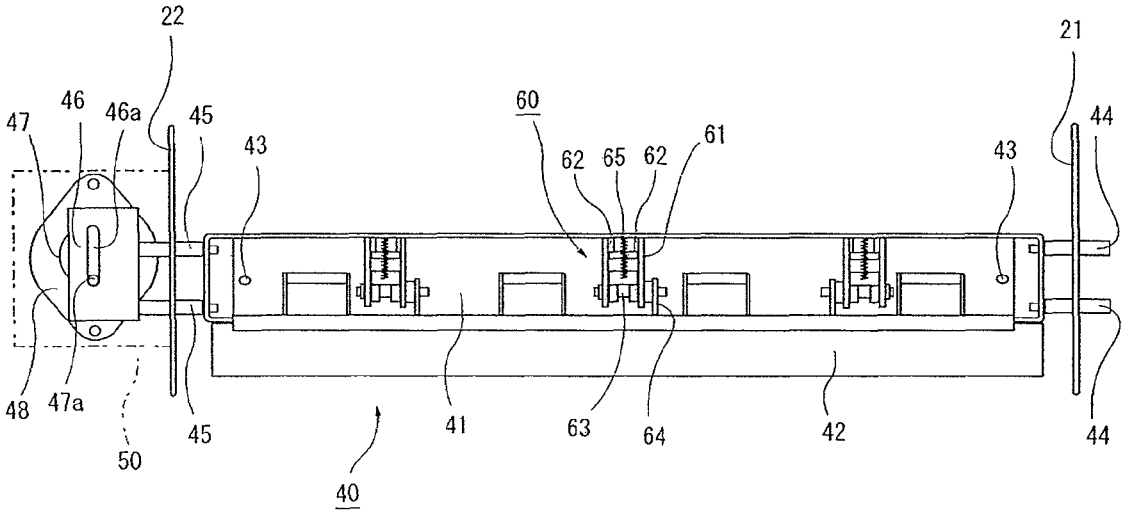
FIG. 8 is a plan view illustrating the shifting unit.
Figure 9:
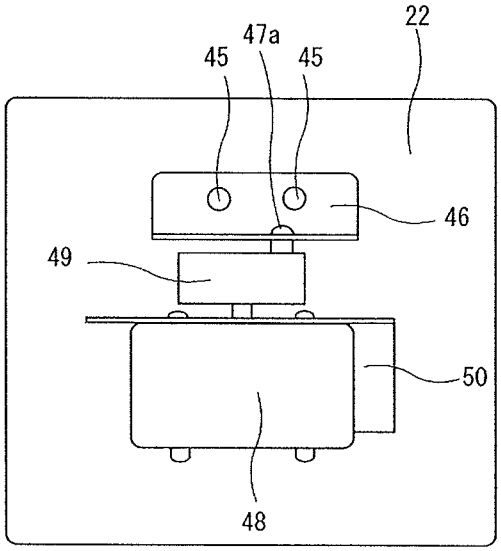
FIG. 9 is a left-side view illustrating the shifting unit.
Figure 10:
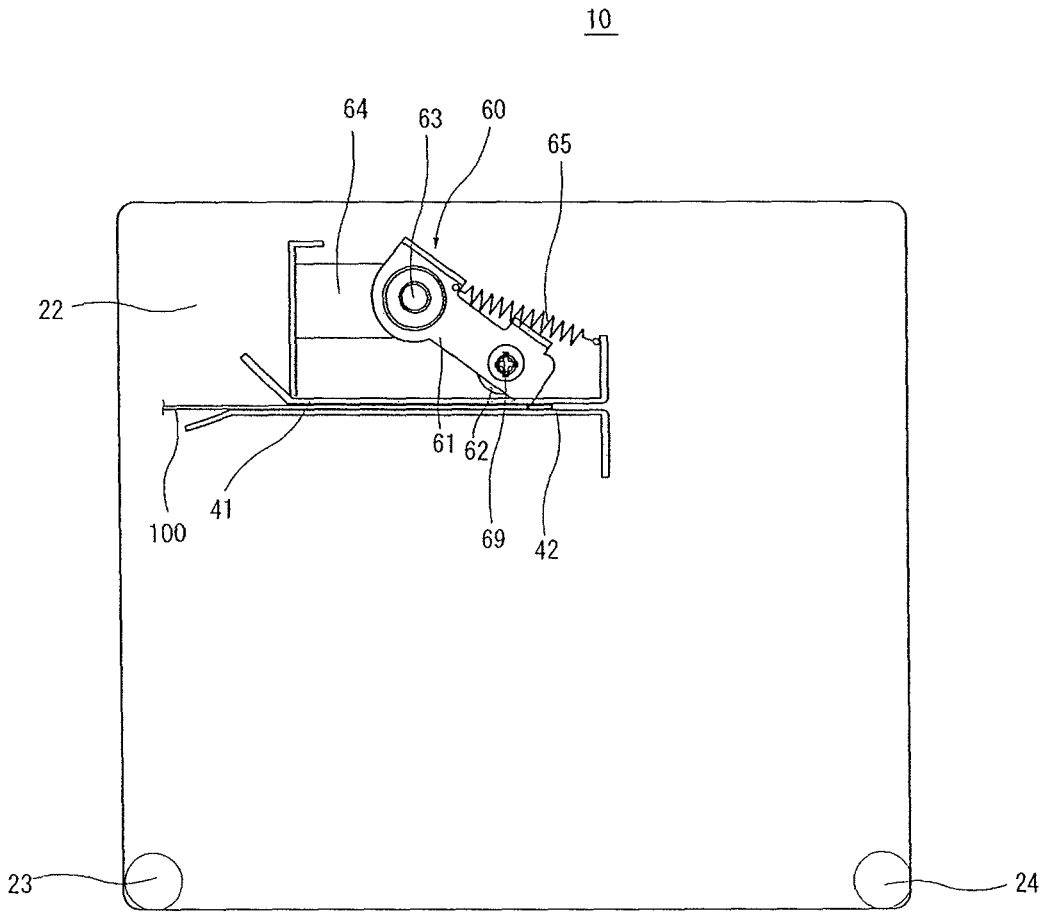
FIG. 10 is a cross-sectional view taken along the line X-X of FIG. 7.
Figure 11:
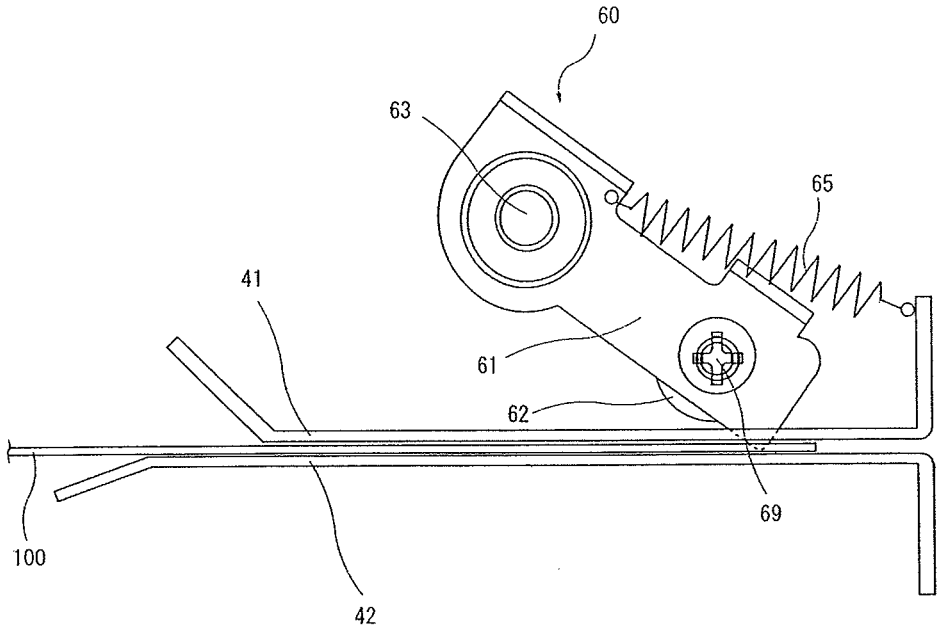
FIG. 11 is a diagram illustrating a notch-forming unit.
Figure 11:
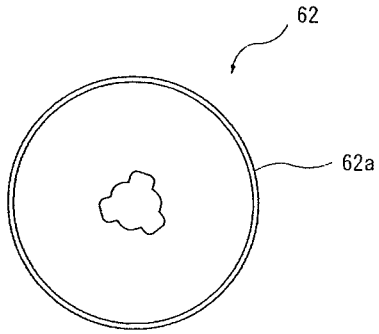
Figure 11:
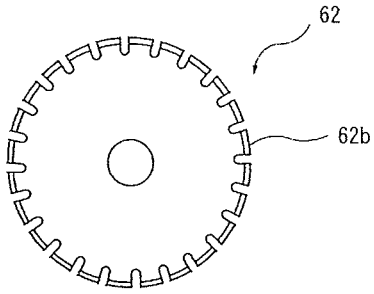

The notch cutter is illustrated in FIGS. 2 to 11. FIG. 2 is a perspective view illustrating the notch cutter. FIG. 3 is a front view illustrating the notch cutter. FIG. 4 is a plan view illustrating the notch cutter. FIG. 5 is a right-side view illustrating the notch cutter. FIG. 6 is a cross-sectional view taken along the line VI-VI of FIG. 3. FIG. 7 is a front view illustrating a shifting unit. FIG. 8 is a plan view illustrating a shifting unit. FIG. 9 is a left side view illustrating a shifting unit. FIG. 10 is a cross-sectional view taken along the line X-X of FIG. 7. FIG. 11 is a diagram illustrating a notch formation portion.

In the notch cutter 20, a pair of side plates 21 and 22 are connected to each other by the lower connection shafts 23 and 24, the upper connection plate 25, and the upper connection shaft 26. The pair of side plates 21 and 22 rotatably supports the entrance side conveyance roller shaft 27 and the exit side conveyance roller shaft 28, the entrance side conveyance roller 29 is installed in the entrance side conveyance roller shaft 27, and the exit side conveyance roller 30 is installed in the exit side conveyance roller shaft 28. A driving gear 31 is installed in the end of the entrance side conveyance roller shaft 27 protruding from the side plate 21, and a driving gear 32 is installed in the end of the exit side conveyance roller shaft 28 protruding from the side plate 21. A timing belt 34 is tensioned around the driving gears 31 and 32 and the motor gear 33. The driving gears 31 and 32 are rotated in synchronization through the motor gear 33 and the timing belt 34 by driving the conveyor motor 35. The conveyor motor 35 is provided in the inner side of the side plate 21 and is arranged in the internal space.

The guide roller 36 is arranged oppositely to the entrance side conveyance roller 29, the guide roller 36 is rotatably supported by the roller bracket 37, and the roller bracket 37 is fixed to the upper connection plate 25. In addition, the guide roller 38 is arranged oppositely to the exit side conveyance roller 30, the guide roller 38 is rotatably supported by the roller bracket 39, and the roller bracket 39 is fixed to the upper connection shaft 26. As the entrance side conveyance roller 29 is rotated, the sheet is supported by the guide roller 36 to enter. As the exit side conveyance roller 30 is rotated, the sheet is supported by the guide roller 36 to exit.

A shifting unit 40 is arranged in the notch cutter 20. The shifting unit 40 has a pair of sheet conveyance guides 41 and 42 located in the upper and lower sides to form a part of the sheet conveyance path. The sheet conveyance guides 41 and 42 are fixed by the pin 43 at the outer side of the sheet conveyance path. In both sides of the upper sheet conveyance guide 41, two guide pins 44 and 45 are fixed. The guide pin 44 is movably supported by the side plate 21, and the guide pin 45 is movably supported by the side plate 22. A manipulation plate 46 is fixed to the leading end of the guide pin 45 protruding from the sideplate 22, and a long hole 46*a* is formed in the manipulation plate 46 along the conveyance direction. The pin 47*a* of the movement link 47 is engaged with the long hole 46*a*, and the movement link 47 is rotated by the movement motor 48. The movement motor 48 is installed in the bracket 50, and the bracket 50 is fixed to the side plate 22.

The movement link 47 is rotated by driving the movement motor 48. As a result, the pin 47*a* is rotated so that the sheet conveyance guide 42 and the sheet conveyance guide 41 fixed to the manipulation plate 46 through the long hole 46*a* are moved together in a width direction of the sheet conveyance path.

The shifting unit 40 is provided with a cutter unit 60. The cutter unit 60 includes a bracket 61 and a pair of cutters 62. Although a pair of cutters 62 is rotatably supported by the support axis 69, the cutters 62 may be fixed to the bracket 61. If a pair of cutters 62 is rotatable, the scratches generated by the notch-cutting may be averaged. Although the cutter 62 according to the present embodiment has a disk-shaped blade 62*a* along the entire circumference as shown in FIG. 11A, the blade 62*a* may be intermittently formed around the disk-shaped circumference as shown in FIG. 11B.

The bracket 61 is rotatably supported by the support axis 63, and the support axis is cantilevered by the upper sheet conveyance guide 41 through the support lever 64. A spring 65 as a biasing member is arranged between the bracket 61 and the upper sheet conveyance guide 41, and the spring 65 applies a force such that a pair of cutters 62 always faces the sheet conveyance path formed by a pair of sheet conveyance guides 41 and 42 from the opening 41*a* formed in the upper sheet conveyance guide 41. A state that the leading end of the bracket 61 abuts on the lower sheet conveyance guide 42 is the initial position. In addition, although the support axis 63 is cantilevered by the support lever 64, the support axis 63 may be supported at both ends by installing another support lever.

(Operation of Cutter Unit)

Figure 12:
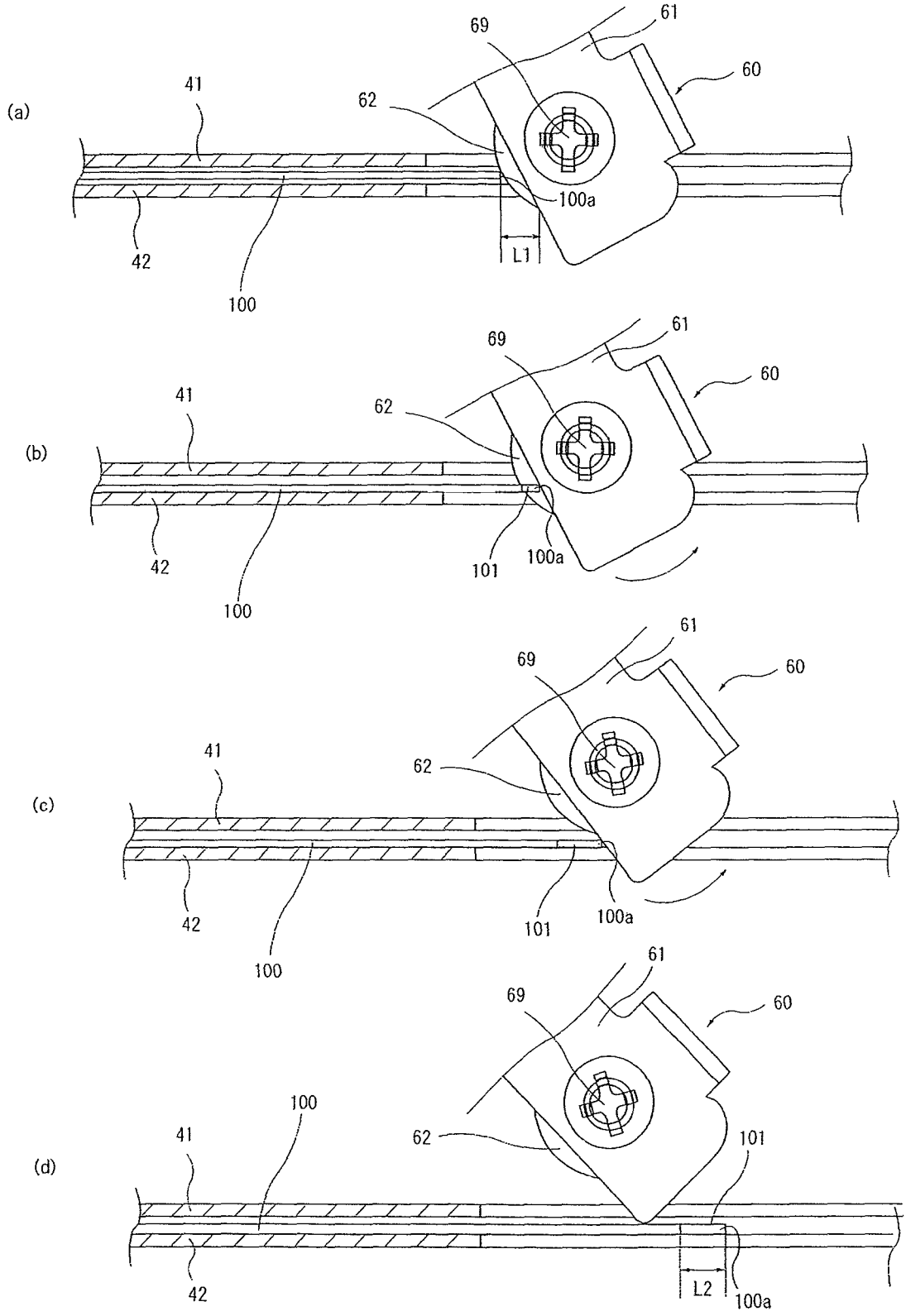
FIGS. 12A to 12D are diagrams illustrating the operation of the cutter unit.

The operation of the cutter unit 60 will be described with reference to FIGS. 12A to 12D. The sheet 100 is conveyed along the sheet conveyance path formed by a pair of sheet conveyance guides 41 and 42, and the end side 100*a* of the conveyed sheet 100 is contacted with a pair of cutters 62 (FIG. 12A). As the sheet 100 is further conveyed, the end side 100*a* of the sheet 100 is pushed to the lower sheet conveyance guide 42 side by a pair of cutters 62, and the notch 101 is formed in the end side 100*a* of the sheet 100 (FIG. 12B). As the sheet 100 having the notch is further conveyed, the end side 100*a* of the sheet 100 except for the position of the notch 101 abuts on the bracket 61 so that the end side 100*a* is pressed to the lower sheet conveyance guide 42 side by the bracket 61, and a reactive force thereof makes the bracket 61 be pushed up against the biasing force of the sprint 65. In addition, a pair of the cutters 62 are separated from the sheet 100 (FIG. 12C), and the sheet 100 passes through the sheet conveyance path (FIG. 12D).

In a pair of cutters 62, a part thereof protrudes from the bracket 61, and the end side 100*a* of the sheet 100 is contacted with the cutter 62, and then, the bracket 61 is pushed up by the end side 100*a* of the sheet 100 except for the notch 101 against the biasing force of the spring 65. Therefore, the length L2 of the notch of the sheet 100 may be set using the protrusion length L1 of the pair of cutters 62, and the binding strength may be adjusted depending on the type, the size, and the thickness of the sheet 100. Although the pair of cutters 62 has a disk shape according to the present embodiment, the invention is not limited thereto. The pair of cutters 62 may have a saw blade formed in the outer circumference or have a star shape. Although various shapes of cutters may be used in this manner, the length L2 of the notch of the sheet 100 may be set in accordance with the length of a protruding part of the cutter which protrudes from the bracket 61. Since the notch of the sheet 100 is formed by the time that the bracket 61 is pushed up, against the biasing force of the spring 65, by the end side 100*a* of the sheet 100 except for the position of the notch 101.

(Movement of Cutter)

Figure 13:
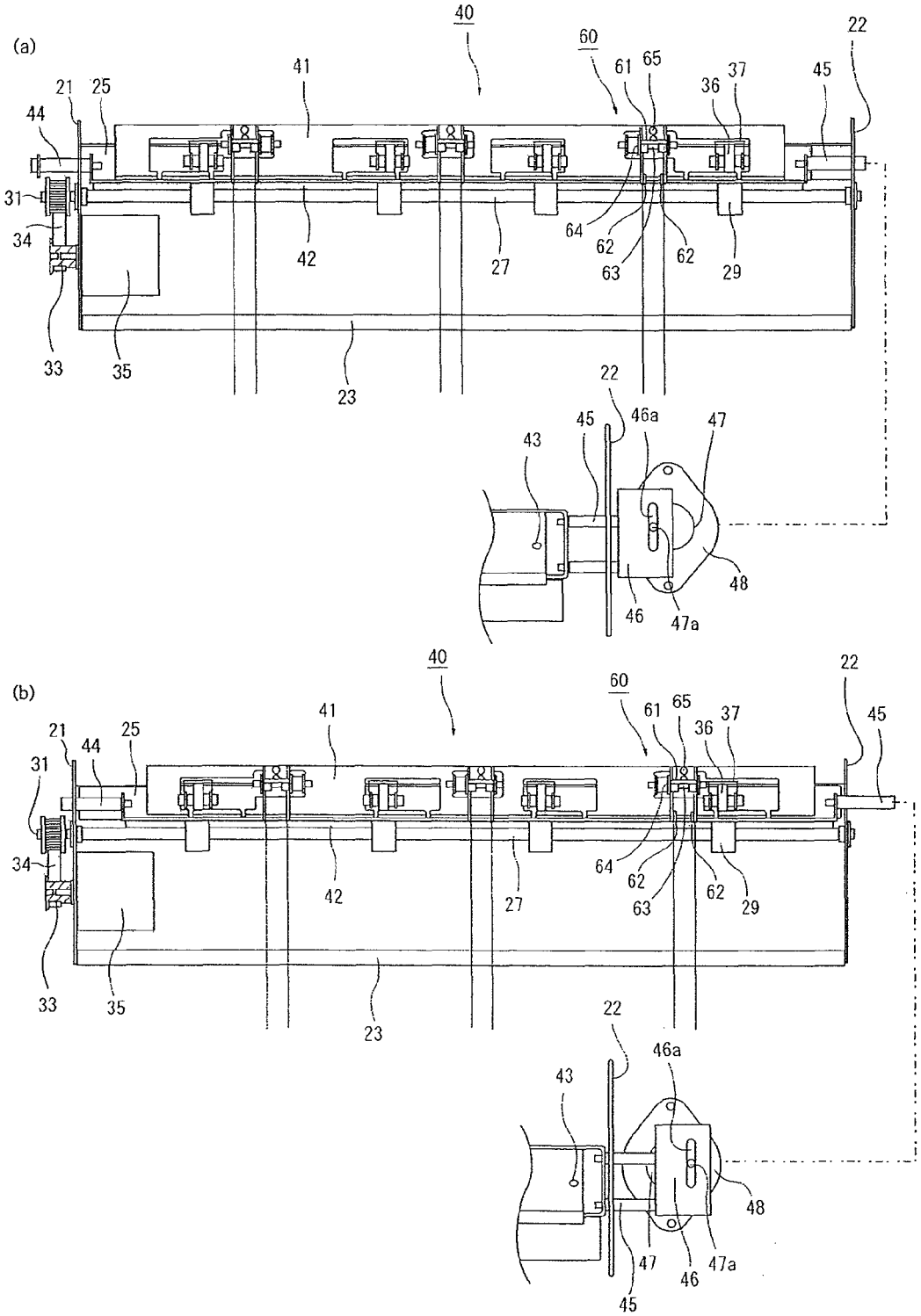
FIGS. 13A and 13B are diagrams illustrating movement of the cutter.
Figure 14:
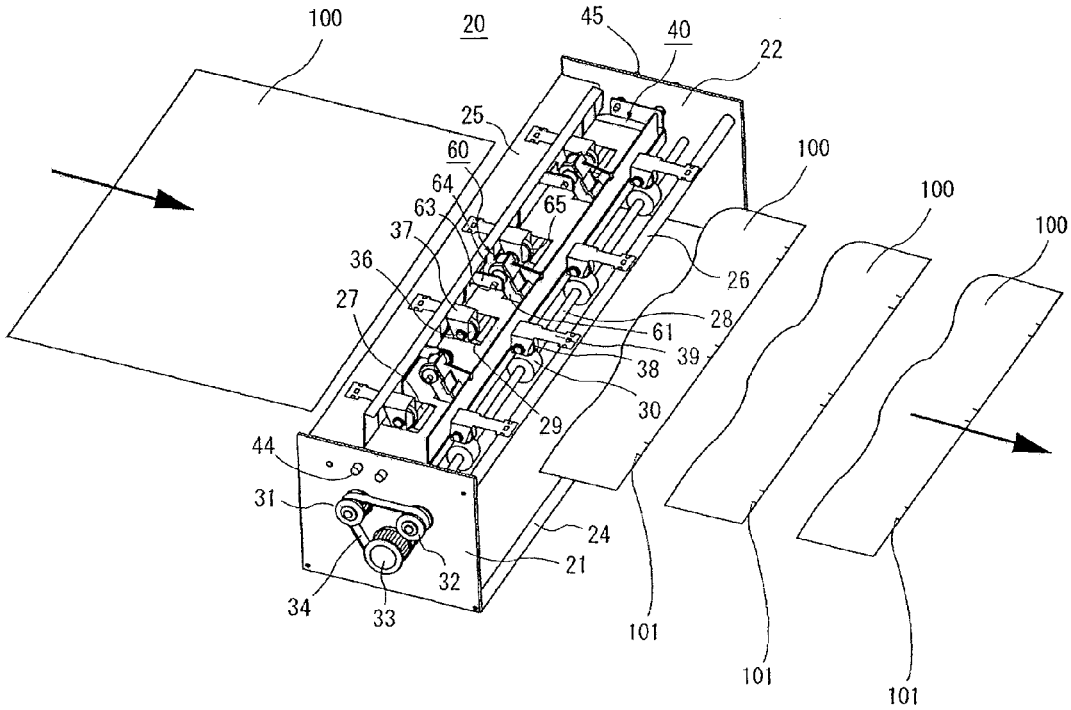
FIG. 14 is a diagram illustrating a change of the notch position of the sheet.

Movement of a pair of cutters will be described with reference to FIGS. 13 and 14. FIGS. 13A and 13B are diagrams illustrating movement of the cutter, and FIG. 14 is a diagram illustrating the change of the notch position in the sheet.

In the present embodiment, the cutter unit 60 is arranged in the shifting unit 40. As the movement motor 48 is driven, the movement link 47 is rotated so that the pin 47*a* moves the long hole 46*a*. As a result, the sheet conveyance guide 42 and the sheet conveyance guide 41 fixed to the manipulation plate 46 are reciprocated together along the width direction of the sheet conveyance path, and accordingly, the cutter unit 60 is moved.

At the timing of the notch 101 of the sheet 100, the movement link 47 is rotated by virtue of driving of the movement motor 48, and the end side of the sheet 100 makes contact with the cutter 62 at the position where the pin 47*a* is located nearest to the side plate 22 so as to form the notch 101 of the sheet 100 (FIG. 13A). Furthermore, the sheet 100 having the notch is conveyed, the bracket 61 is pressed and pushed up against the biasing force of the spring 65 by the end side of the sheet 100 except for the notch 101. Then, the pair of cutters 62 is separated from the sheet 100, and the sheet 100 passes through the sheet conveyance path.

The movement link 47 is rotated by driving the movement motor 48 before the next sheet 100 is inserted into the sheet conveyance path, so that the pin 47*a* is moved to a position farthest to the side plate 22. At that position, the end side 100*a* of the next sheet 100 makes contact with the cutter 62 so as to form the notch 101 of the sheet 100 (FIG. 13B). Furthermore, the next sheet 100 having the notch is conveyed, and the bracket 61 is pushed up against the biasing force of the spring 65 by the end side 100*a* of the sheet 100 except for the notch 101 so that a pair of cutters 62 are separated from the sheet 100, and the sheet 100 passes through the sheet conveyance path. In this manner, the pin 47*a* is reciprocated between the position nearest to the side plate 22 and the position farthest from the side plate 22 to form the notch 101 in the sheet 100 (FIG. 14).

Although the notch 101 is formed in the sheet 100 by reciprocating the pin 47*a* between the position nearest to the side plate 22 and the position farthest from the side plate 22 in the present embodiment, the notch 101 of the sheet 100 may be formed in the intermediate position, or the notch position may be set depending on the rotation angle of the pin 47*a*.

In this manner, it is possible to obtain the binding strength using the notch 101 by forming the notch 101 in the end side glued in the binding process of the sheet 100. Furthermore, it is possible to prevent scraps from being generated and scattered which makes the device get dirty, and to get rid of necessity of installing a scrap disposer.

The end side of the conveyed sheet 100 makes contact with the cutter 62 to form the notch 101, and the bracket 61 is pressed against the biasing force of the spring 65 of the biasing unit as the sheet 100 having the notch 101 is conveyed. The cutter 62 is separated from the sheet 100, and the notch 101 is automatically formed by conveying the sheet 100, so that a simple structure using the conveyance of the sheet 100 can be obtained.

Second Embodiment (Entire Configuration of Binding Apparatus)

Figure 15:
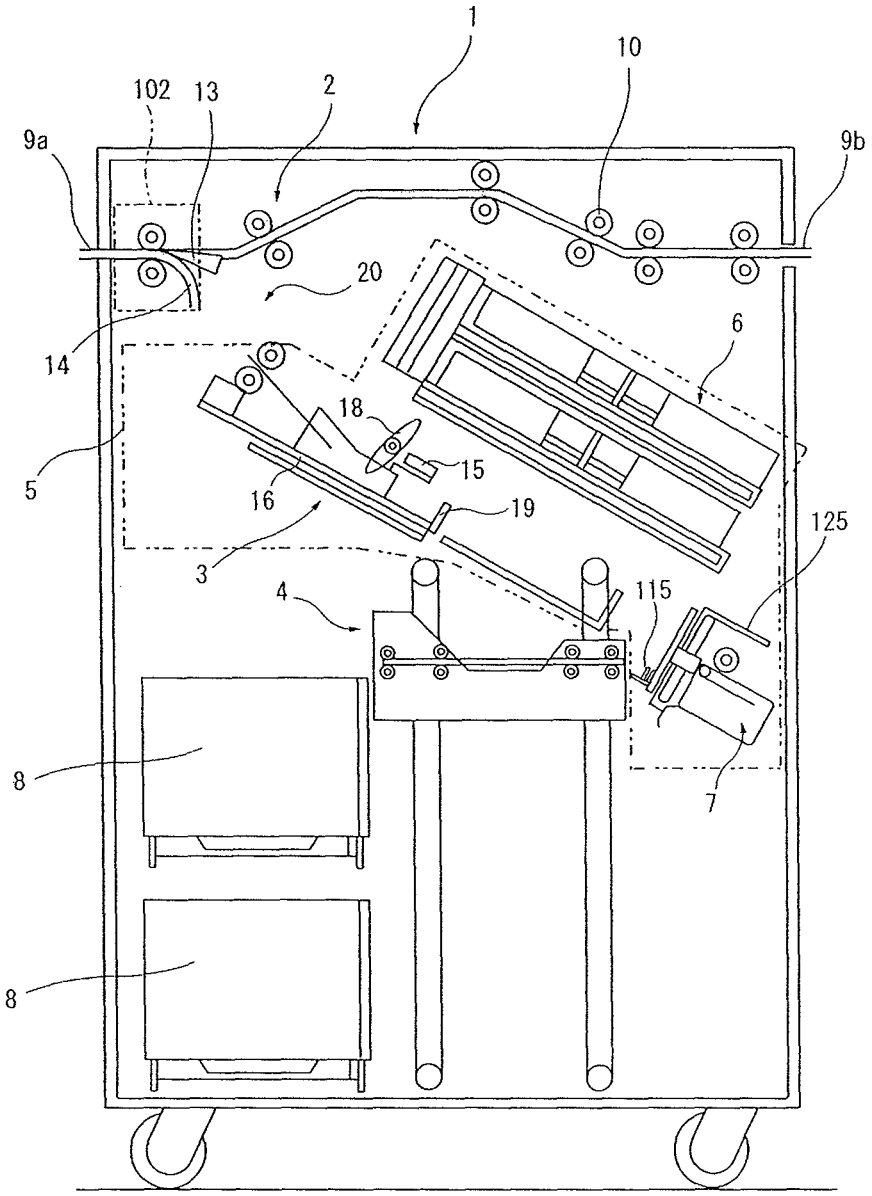
FIG. 15 is a schematic diagram illustrating the configuration of the entire binding apparatus according to a second embodiment.
Figure 16:
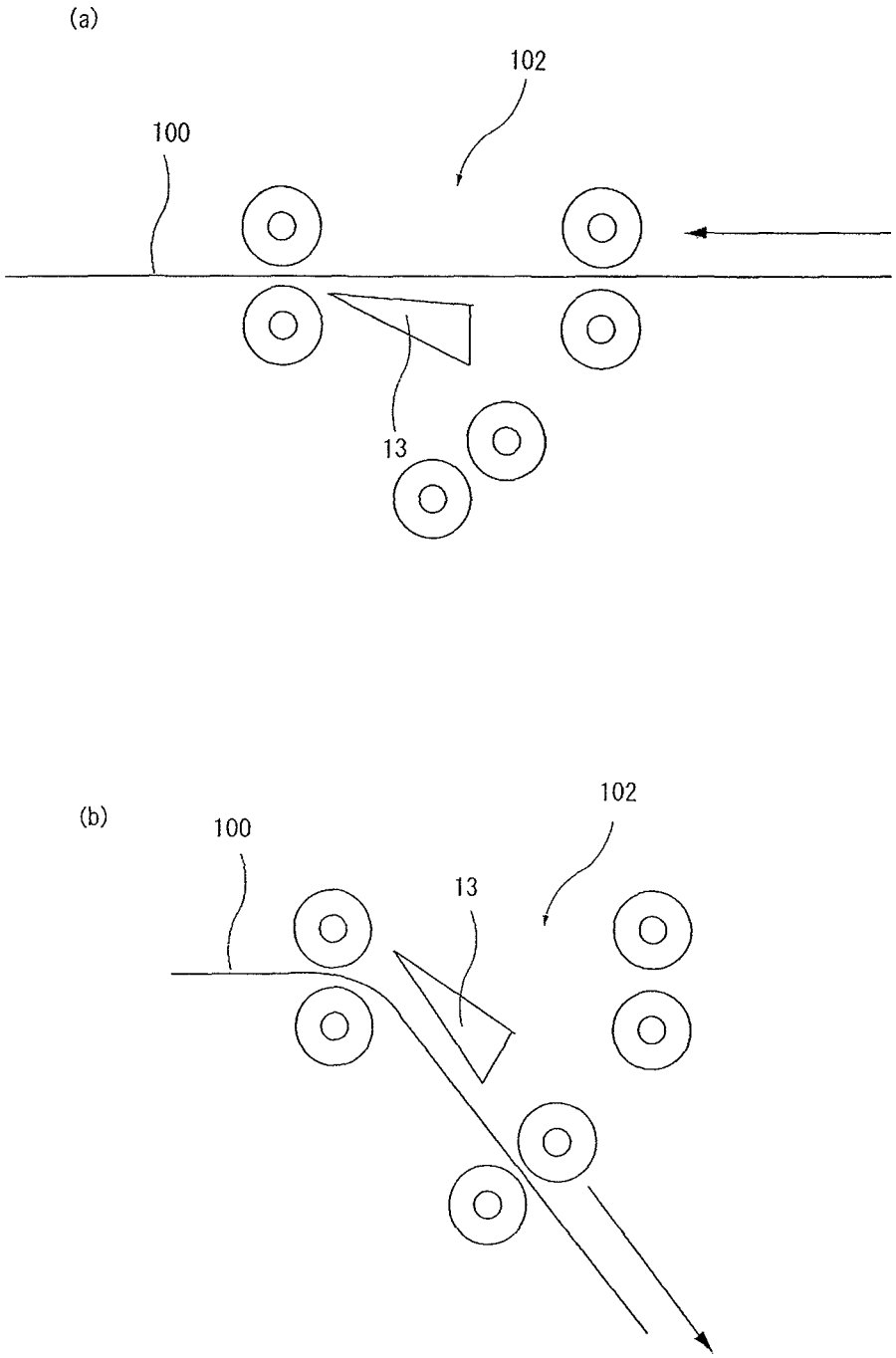
FIGS. 16A and 16B are diagrams illustrating a switchback.

The binding apparatus according to the present embodiment is illustrated in FIGS. 15 and 16. FIG. 15 is a schematic diagram illustrating the entire configuration of the binding apparatus, and FIGS. 16A and 16B are diagrams illustrating a switch-back.

Similar to the first embodiment, the binding apparatus 1 includes a sheet-processing unit 5 having a sheet aligner 3, a tape feeder unit 6, and a binding unit 7, a sheet-conveying unit 2, a binding conveyor 4, and a stacker 8. The notch cutter 20 is also provided similar to the first embodiment.

In the present embodiment, a switch-back path 102 is arranged in the sheet conveyance path of the binding apparatus 1, and the notch cutter 20 included in the notch-forming unit is provided in the next stage of the switch-back path 102. For example, if the binding apparatus 1 is connected to the right side of the image-forming apparatus, and the sheet 100 is inserted from the left side of the sheet conveyance path of the binding apparatus 1, the sheet is conveyed to the notch cutter 20 using the sorting guide 13 without using the switch-back path 102, and the notch is formed in the end side in front side of the sheet 100 conveyance direction. Meanwhile, if the binding apparatus 1 is connected to the left side of the image-forming apparatus, and the sheet 100 is inserted from the right side of the sheet conveyance path of the binding apparatus 1, the sheet 100 is guided to the switch-back path 102 through the sorting guide 13 (FIG. 16A) to switch back the sheet 100. Then, the sheet is conveyed to the notch cutter 20 through the sorting guide 13 (FIG. 16B), and the notch is formed in the end side of the sheet 100 in the front side of the conveyance direction. Therefore, this embodiment may be used in various image-forming apparatuses.

(First Embodiment of Binding Unit)

(Entire Configuration of Binding Unit)

Figure 17:
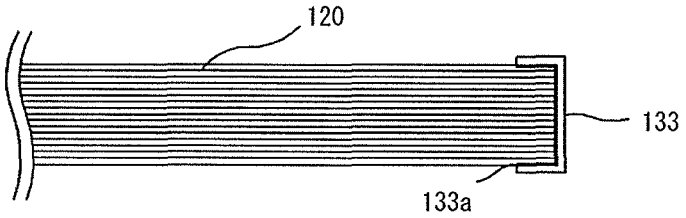
FIG. 17 is a diagram illustrating a sheet state to be bound.
Figure 18:
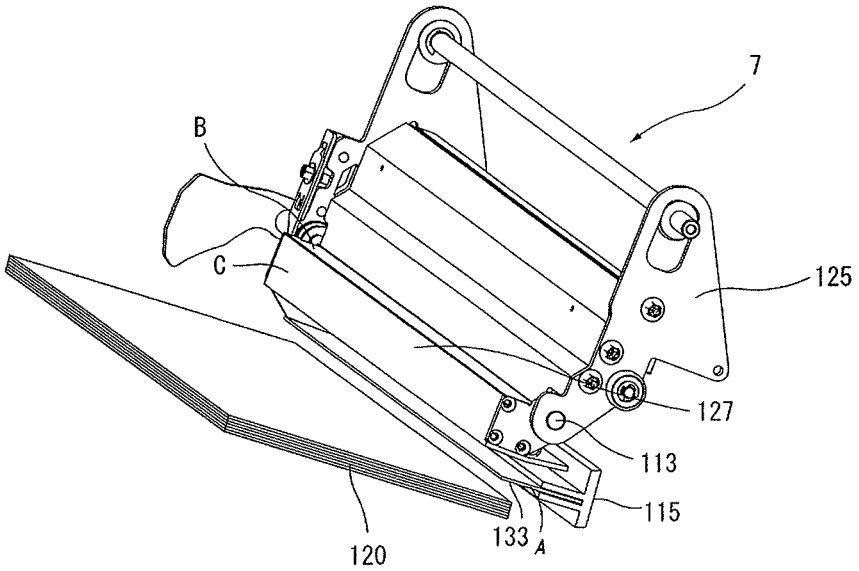
FIG. 18 is a solid diagram schematically illustrating a binding unit of the comparison example.
Figure 19:
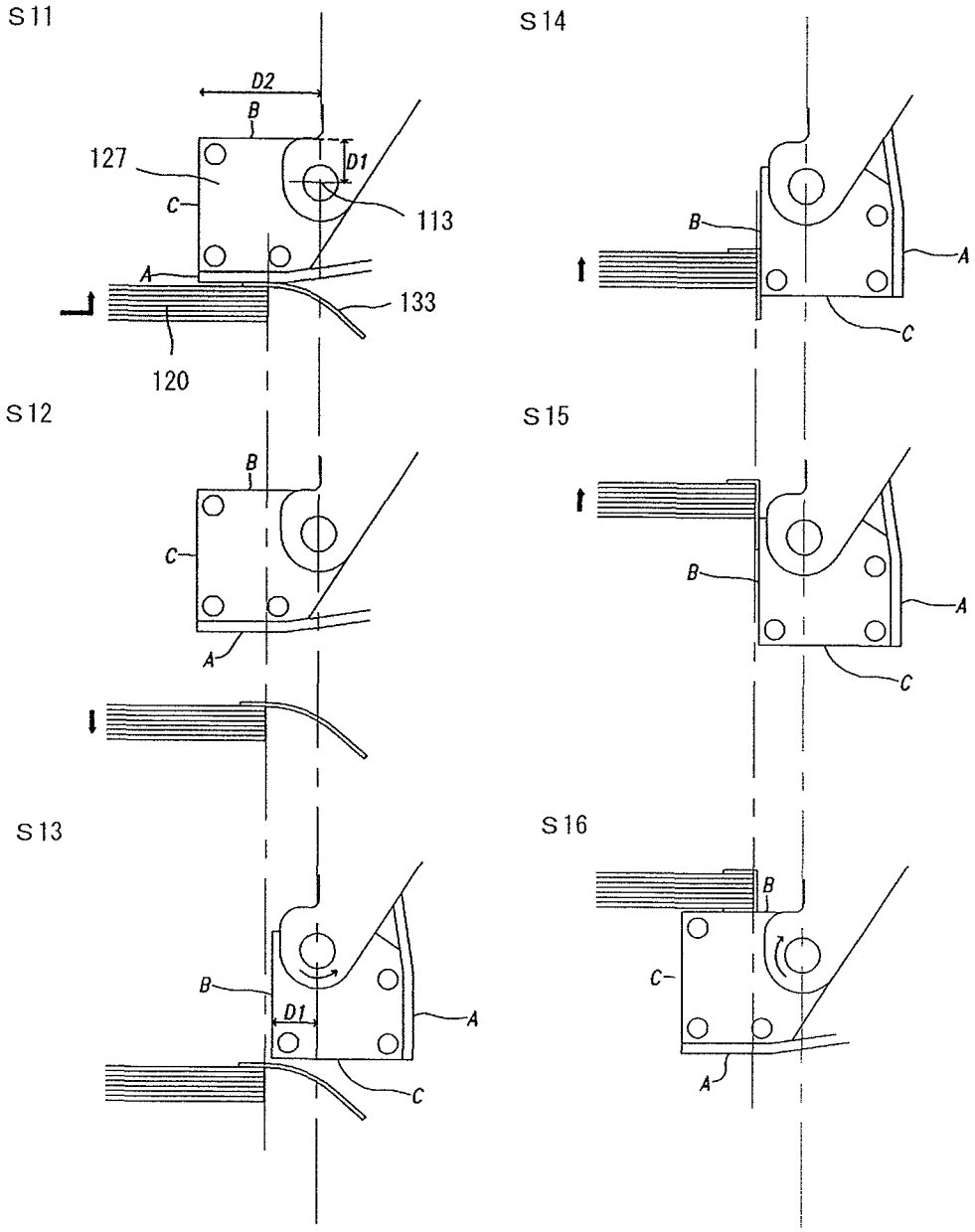
FIG. 19 is a diagram illustrating a binding process of the comparison example.

The binding unit according to the first embodiment will be described with reference to FIGS. 17 to 19. FIG. 17 is a diagram illustrating a sheet state bound using the binding unit. FIG. 18 is a perspective view schematically illustrating a binding unit having a heater unit according to a comparison example. FIG. 19 is a diagram illustrating a binding process using a heater unit according to a comparison example.

The binding unit 7 according to the present embodiment includes a tape guide unit 115 and a heater unit 125. As the sheet bundle 120 moves, the binding tape 133 fed from the tape feeder unit 6 is supplied to the heater unit 125 through the tape guide unit 115, and the sheet bundle 120 is bonded to the stitch portion using the adhesive 133*a* by adding heat to the binding tape 133 supplied to the heater unit 125 so that the binding of the sheet bundle 120 is completed.

The structure and the operation of the heater unit 125 will be described with reference to FIGS. 18 and 19. The heater unit 125 includes a rectangular heater 127 provided rotatably with respect to the support axis 113.

The rectangular heater 127 has faces A, B, and C perpendicular to each other. The faces B and A are opposite to each other, and the faces C and B are configured such that the selected direction is located in front by rotating the support axis 113. The distance D1 between the face B and the support axis 113 is smaller than the distance D2 between the face C and the support axis 113.

The binding tape 133 is delivered to the position parallel to the face A of the heater 127 through the heater unit 115 while the face C of the heater 127 is positioned in front, and the sheet bundle 120 is moved to the attaching position of the binding tape 133. Then, the stitch portion of the sheet bundle 120 abuts on the face A direction of the heater 127 along with the binding tape 133.

If a part of the binding tape 133 is pressed by the face A of the heater 127 and bonded with the stitch portion of the sheet bundle 120, the tape guide unit 115 is moved to the original position in order not to obstruct the binding.

Specifically to say that in this binding process, as described in step S11 of FIG. 19, the binding tape 133 is pressed to the sheet bundle 120 and the face A of the heater 127 and welded to the upper surface of the end of the sheet bundle 120 by applying heat using the heater 127.

Subsequently, after the tape guide unit 115 is moved to the original position, the sheet bundle 120 is bound through step S12 in which the sheet bundle 120 is lowered by a predetermined interval from the heater 127, step S13 in which the face B is directed to the front surface by rotating the heater 127 by 90° in the arrow direction, step S14 in which the sheet bundle 120 lowered with a predetermined interval is lifted toward the heater 127 to weld the binding tape 133 to the side face of the sheet bundle 120, step S15 in which the sheet bundle having a welded side face is moved upwardly further, and step S16 in which the heater 127 is rotated to the original position, and the remaining end of the sheet bundle 120 is bonded to the binding tape 133 using the heat of the face B.

However, in a case where the welding using the binding tape 133 is performed using the structure of the heater unit 125, the heater 127 protrudes over the tape area up to the inner side of the sheet bundle 120 through steps S11 and S16 of FIG. 19. Therefore, the ink of the character printed on the sheet of the sheet bundle 120 exposed to heat may be unintentionally blurred.

Figure 20:
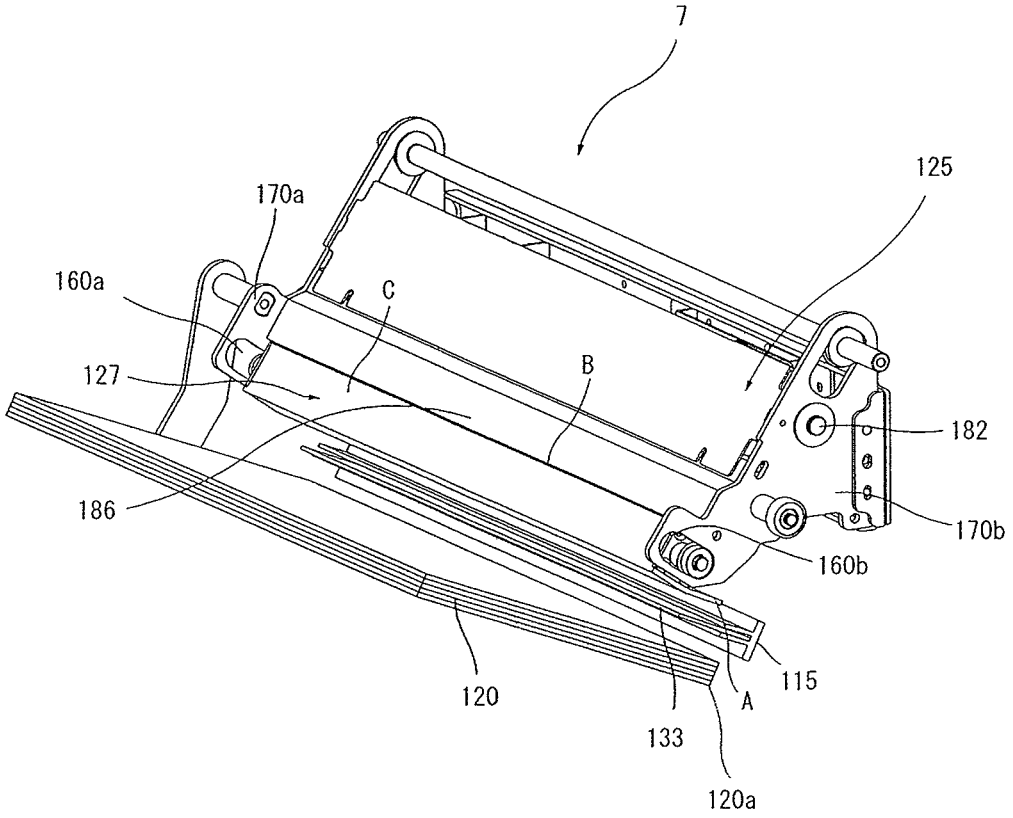
FIG. 20 is a solid diagram schematically illustrating a binding unit according to an embodiment.
Figure 21:
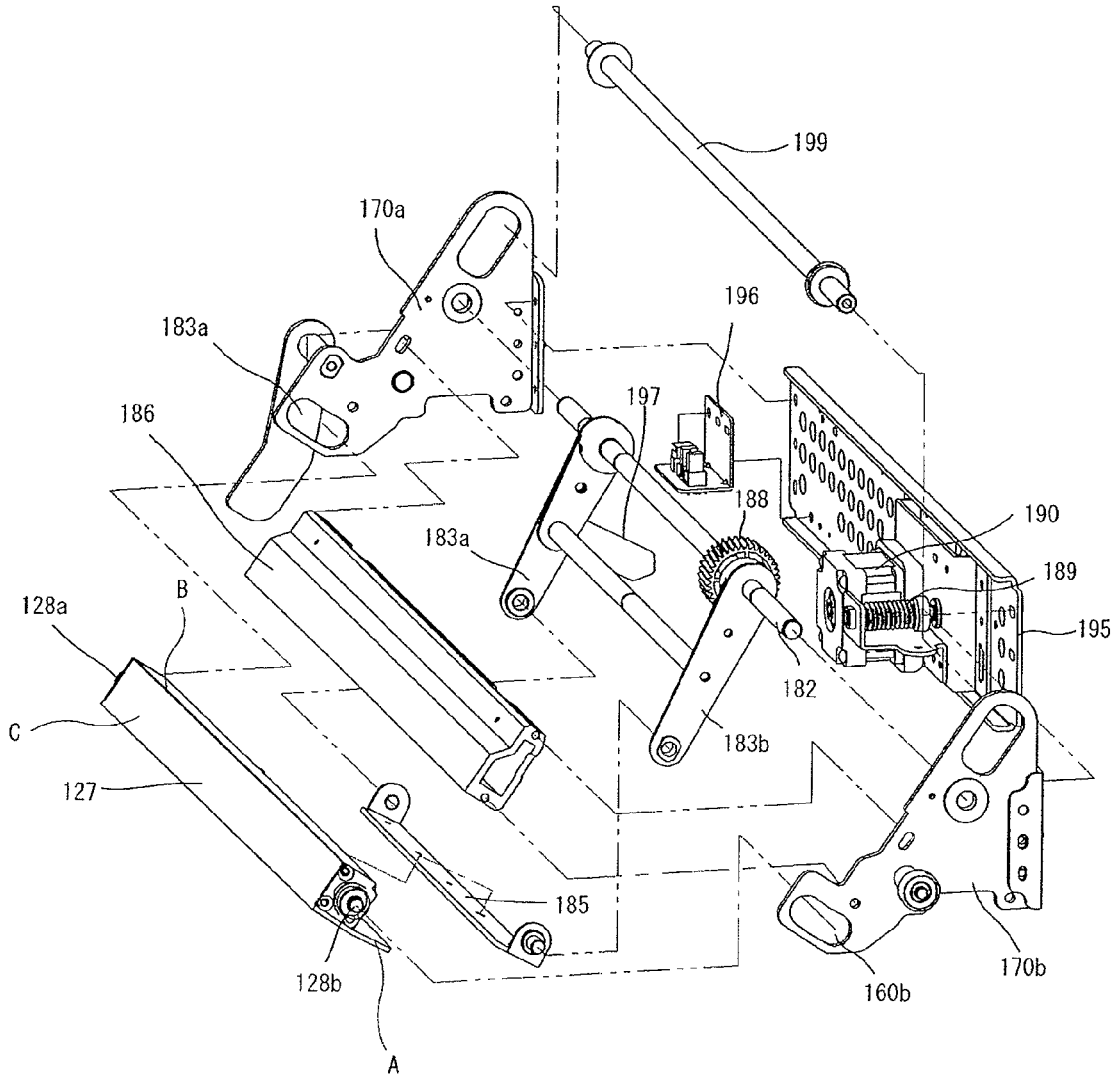
FIG. 21 is an exploded perspective diagram illustrating a heater unit according to the embodiment.
Figure 22:
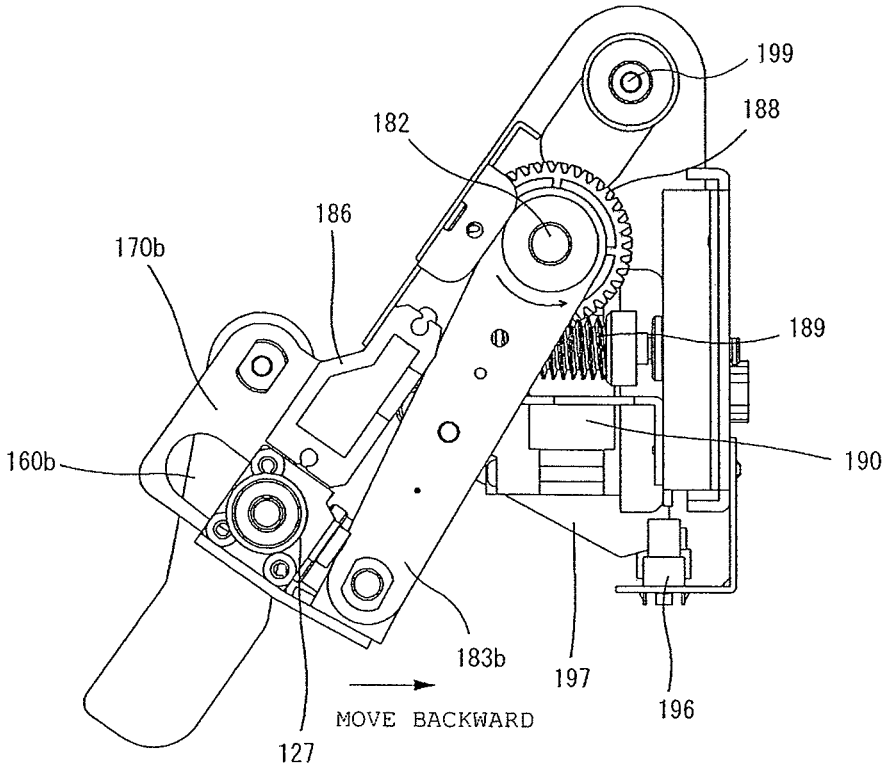
FIG. 22 is a side view illustrating a state that the heater of the heater unit is moved backward according to the embodiment.
Figure 23:
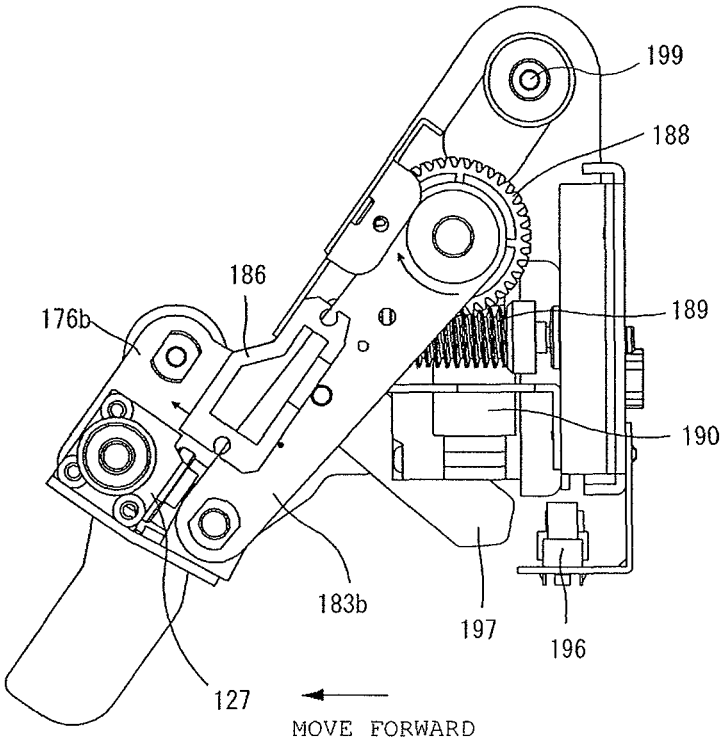
FIG. 23 is a side view illustrating a state that the heater of the heater unit is moved forward according to the embodiment.
Figure 24:
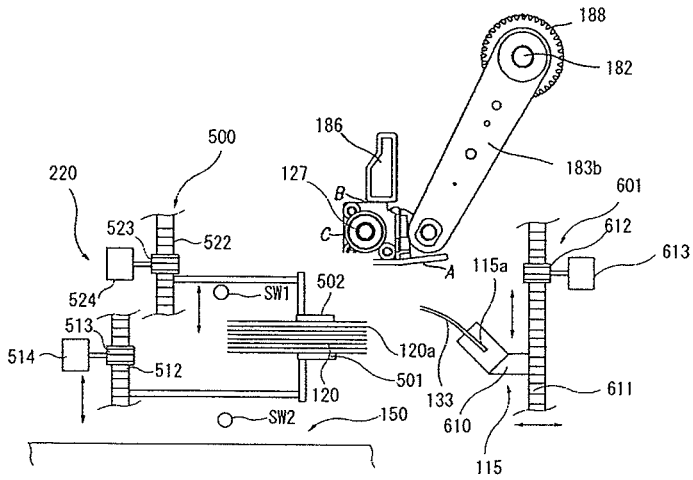
FIGS. 24A and 24B are diagrams illustrating configurations of the sheet bundle shifting unit and the tape guide unit shifting mechanism.
Figure 24:
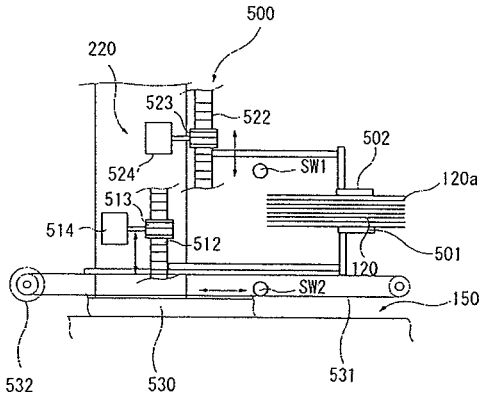
Figure 25:
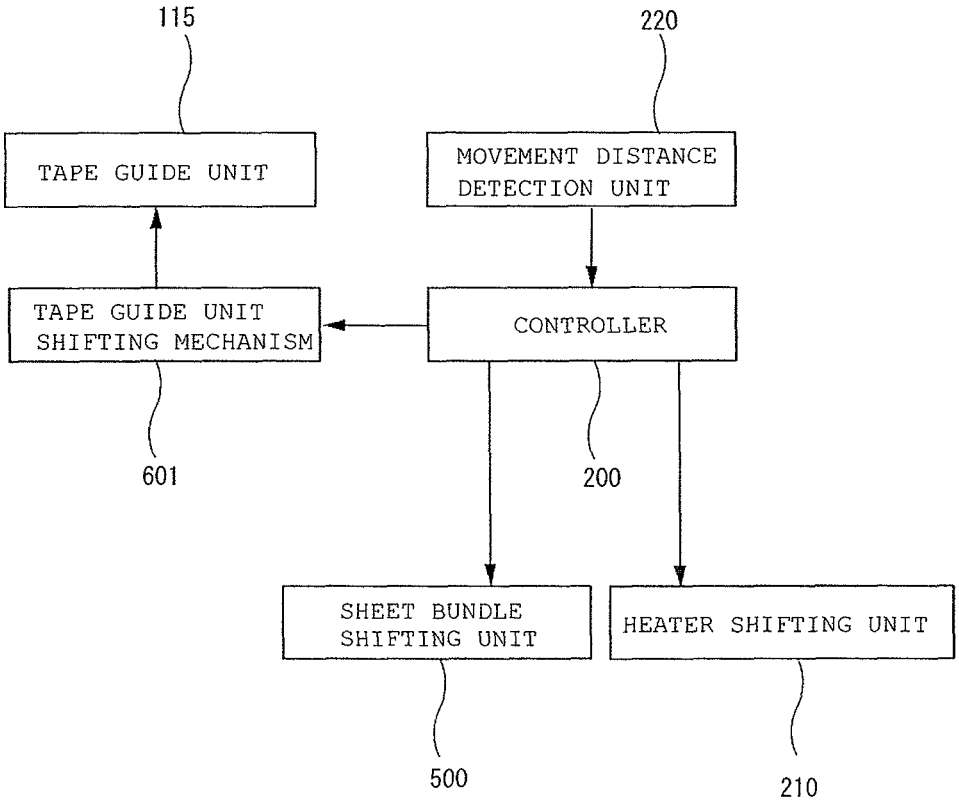
FIG. 25 is a control block diagram illustrating the binding unit.
Figure 26:
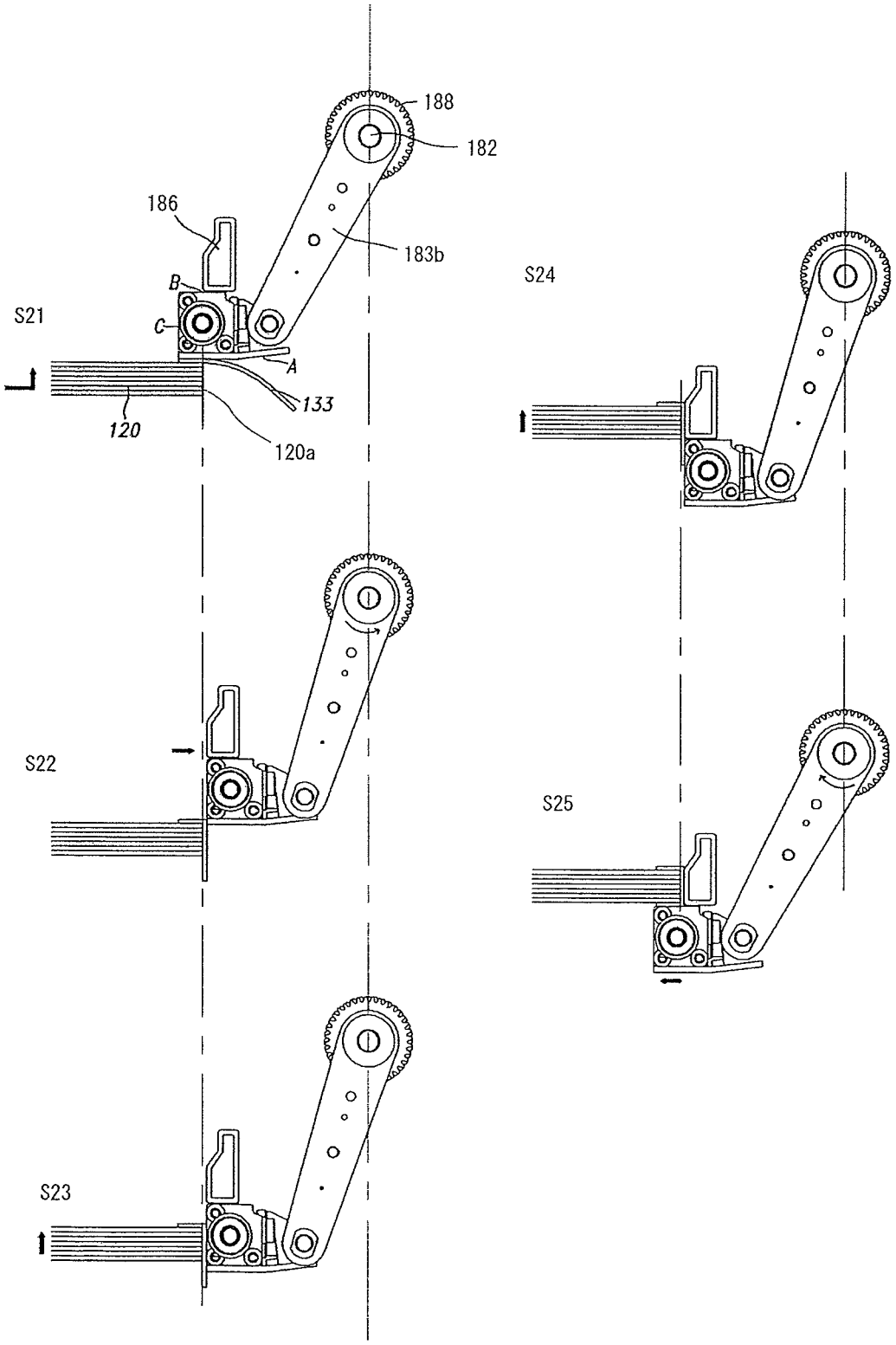
FIG. 26 is a diagram illustrating a binding process.

For this reason, the binding unit capable of improving the binding quality by preventing blurring of the character printed on the sheet during the tape welding process of the sheet bundle 120 will be described with reference to FIGS. 20 to 26. FIG. 20 is a solid diagram schematically illustrating the binding unit having the heater unit. FIG. 21 is an exploded perspective view illustrating the heater unit. FIG. 22 is a side view illustrating a state that the heater of the heater unit is moved backward. FIG. 23 is a side view illustrating a state that the heater of the heater unit moves forward. FIGS. 24A and 24B are diagrams illustrating configurations of the sheet bundle shifting unit and the tape guide unit shifting mechanism. FIG. 25 is a control block diagram of the binding unit. FIG. 26 is a diagram illustrating a binding process.

First, the structure of the binding unit 7 will be described with reference to FIG. 20. The heater unit 125 includes a rectangular heater 127 inserted into slits 160*a* and 160*b* formed in the lower end of the support plates 170*a* and 170*b* and provided so as to move forward and backward in a straight-line direction along with the surface of the sheet bundle 120.

The rectangular heater 127 includes a face A and an opposite face B perpendicular to the front surface C. In a state that the face C of the heater 127 serves as a front surface, the binding tape 133 is delivered to the position substantially parallel to the end face A of the heater 127 through the tape guide unit 115, and the sheet bundle 120 gripped by the sheet bundle shifting unit 500 is moved to the attaching position of the binding tape 133. Then, the stitch portion 120*a* of the sheet bundle 120 abuts in the direction of the end face A of the heater 127 along with the binding tape 133.

The sheet bundle shifting unit 500 has lower and upper heater clamps 501 and 502 for clamping the sheet bundle 120 as illustrated in FIG. 24A and is moved vertically by interposing the stitch portion 120*a* side of the sheet bundle 120 conveyed under the heater 127 using the lower and upper heater clamps 501 and 502. A mechanism for moving the lower and upper heater clamps 501 and 502 is configured such that the lower heater clamp 501 is connected to the lock 512 through the connecting member 511, the lock 512 meshes with the pinion 513, and the lower heater clamp 501 is moved vertically by rotating the pinion 513, using the step motor 514, whereas the upper heater clamp 502 is connected to the lock 522 through the connecting member 521, the lock 522 meshes with the pinion 523, and the upper heater clamp 502 is moved vertically by rotating the pinion 523 using the step motor 524. The step motors 514 and 524 are driven by the control unit 200.

The first detection sensor SW1 is arranged in the position corresponding to the lower heater clamp 501, and the second detection sensor SW2 is arranged in the position corresponding to the upper heater clamp 502. The detection information of the first and second detection sensors SW1 and SW2 are sent to the control unit 200. The upper heater clamp 502 waits at the position where the second detection sensor SW2 enters a detection state ON, and the lower heater clamp 501 awaits at the position where the first detection sensor SW1 enters a detection state ON. As the sheet bundle 120 is supplied on the lower heater clamp 501, the lower heater clamp 501 where the sheet bundle 120 is loaded is moved upwardly to clamp the sheet bundle 120. As the lower heater clamp 501 starts to move, the first detection sensor SW1 enters a non-detection state OFF, and the lower heater clamp 501 is lifted so that the sheet bundle 120 abuts on the upper heater clamp 501. As the upper heater clamp 502 is pressedly moved, the interposing of the sheet bundle 120 using the lower and upper heater clamps 501 and 502 is completed, and the second detection sensor SW2 enters a non-detection state OFF.

The time elapsing until the second detection sensor SW2 of the upper heater clamp 502 has the non-detection state OFF after the first detection sensor SW1 of the lower heater clamp 501 has the non-detection state OFF is measured based on the step number of the step motor 514. This enables configuration of a movement distance detection unit 220 for detecting a movement distance until the sheet bundle 120 is clamped by the lower and upper heater clamps 501 and 502 after the lower heater clamp 501 starts to rise. The control unit 200 computes the thickness of the sheet bundle 120 based on the detected movement distance, and the sheet bundle shifting unit 500 is moved by a distance depending on the computed thickness of the sheet bundle 120 under control of the control unit 200.

The sheet bundle shifting unit 500 may be provided with a mechanism for horizontally moving the lower and upper heater clamps 501 and 502 as illustrated in FIG. 24B. For example, the binding unit 7 is movably supported by the support body 530, the timing belt 531 is connected to the support body 530, and the lower and upper heater clamps 501 and 502 are horizontally moved to the heater 127 by driving the timing belt 531 using the step motor 531. The step motor 532 is driven by the control unit 200.

The sheet bundle 120 interposed between the lower and upper heater clamps 501 and 502 is lowered and moved to the position where the second detection sensor SW2 enters a detection state ON. At that position, the sheet bundle 120 is horizontally moved to the heater 127 by driving the timing belt 531 using the step motor 532. The sheet bundle shifting unit 500 is controlled in this manner, and the sheet bundle 120 is horizontally moved from the position where sheet bundle 120 is interposed between the lower and upper heater clamps 501 and 502 and placed under the heater 127.

The binding unit 7 includes a tape guide unit 115 for receiving and holding the supplied binding tape 133 and a tape guide unit shifting unit 601 for moving the tape guide unit 115 between the receiving position and the attaching position. The tape guide unit 115 receives and holds the binding tape 133 supplied to the holding unit 115*a* at the receiving position. The tape guide unit 115 is connected to the lock 611 through the connecting plate 610 to make the pinion 612 mesh with the lock 611, and the tape guide unit shifting unit 601 is moved vertically by rotating the pinion 612 using the step motor 613.

The control unit 200 controls the tape guide unit shifting unit 601 to move the tape guide unit 115, the tape guide unit 115 receives and holds the binding tape 133 supplied at the receiving position, the sheet bundle 120 is lifted while the binding tape 133 is overlapped in the upper surface of the stitch portion 120*a*, the binding tape 133 is welded to the upper surface of the stitch portion 120*a* of the sheet bundle 120 at the pressed-bonding position using the heater 127, the binding tape 133 is welded, and then, the tape guide unit 115 is recovered to the receiving position. In this manner, as a part of the binding tape 133 is pressed with the stitch portion 120*a* of the sheet bundle 120 by the end face A of the heater 127, the tape guide unit 115 is moved to the original receiving position in order not to obstruct the binding.

The structure of the heating unit 125 for heating the binding tape 133 will be described with reference to FIGS. 21 to 23. The support plates 170*a* and 170*b* having slits 160*a* and 160*b*, respectively, are provided, and the shaft 182 is provided rotatably between the support plates 170*a* and 170*b*. Both ends 128*a* and 128*b* of the heater 127 are coupled to the slits 160*a* and 160*b*, respectively, so that the heater 127 can move forward and backward along the slit 160*a* and 160*b*. Meanwhile, a pair of arms 183*a* and 183*b* are fixed to the shaft 182, which is coupled to the heater 127 through the connecting member 185.

While the end of a pair of arms 183*a* and 183*b* may be directly coupled to the heater 127, the reason of interposing the connecting member 185 is to prevent the arms 183*a* and 183*b* from being obstructed by the structure such as the guide plate 186 thereon when the arms 183*a* and 183*b* are rotated in synchronization with the shaft 182.

Meanwhile, the shaft 182 is provided with a worm wheel 188. The fixation plate 195 having a worm gear 189 meshing with the worm wheel 188 is coupled to the support plates 170*a* and 170*b*. The fixation plate 185 is provided with a motor 190 for driving the worm 189, and the sensor 196 is fixed to the side of the fixation plate 195. The sensor 196 is to sense the home positions of the arms 183*a* and 183*b*. The home position of the arm is sensed by a plate-shaped protrusion 197 protruding in the middle of the arm 183*a*.

As illustrated in FIG. 22, a heater shifting unit 210 for shifting the heater 127 in a straight line is configured such that the heater 127 moves backward by rotating the arms 183*a* and 183*b* counterclockwise as the worm gear 189 rotates the worm wheel 188 or the heater 127 moves forward in the direction parallel to the sheet surface of the sheet bundle 120 by rotating the arms 183*a* and 183*b* clockwise as illustrated in FIG. 23. The distance between the forward movement position and the backward movement position is adjusted by appropriately adjusting the rotation of the worm wheel 188 by the worm gear 189. The shaft 199 is fixed in the support plates 170*a* and 170*b* to adjust the position of the heater unit 125 in the binding unit 7.

In step S21 of FIG. 26, as the binding tape 133 is pressed to the end face A of the heater 127 and the sheet bundle 120 and welded to the upper surface of the stitch portion 120*a* of the sheet bundle 120 by virtue of the heat of the heater 127, the tape guide unit 115 moves backward and waits at the position where the binding process for welding the binding tape 133 is not obstructed.

Particularly, the rotation of the worm gear 189 is controlled under a predetermined program such that the end of the heater 127 can move to the position matching with the end of the binding tape 133.

Subsequently, the heater 127 is made to move backward to the side face position of the stitch portion 120*a* of the sheet bundle 120 in the arrow direction by driving the worm wheel 188 in step S22. Subsequently, the sheet bundle 120 is moved in the arrow direction so that the side face of the stitch portion 120*a* of the sheet bundle 120 makes contact with the front surface C of the heater 127 in step S23. Subsequently, after the side face of the stitch portion 120*a* of the sheet bundle 120 is welded, the sheet bundle 120 is further lifted such that the side face position of the stitch portion 120*a* of the sheet bundle 120 is generally positioned in the end of the opposite face B of the heater 127 in step S24. Subsequently, the heater 127 is made to move forward to the lower surface position of the stitch portion 120*a* of the sheet bundle 120 in the arrow direction by driving the worm wheel 188, and the binding tape 133 is welded to the lower surface of the stitch portion 120*a* of the sheet bundle 120 in step S25.

(Operation of Binding Unit)

Figure 27:
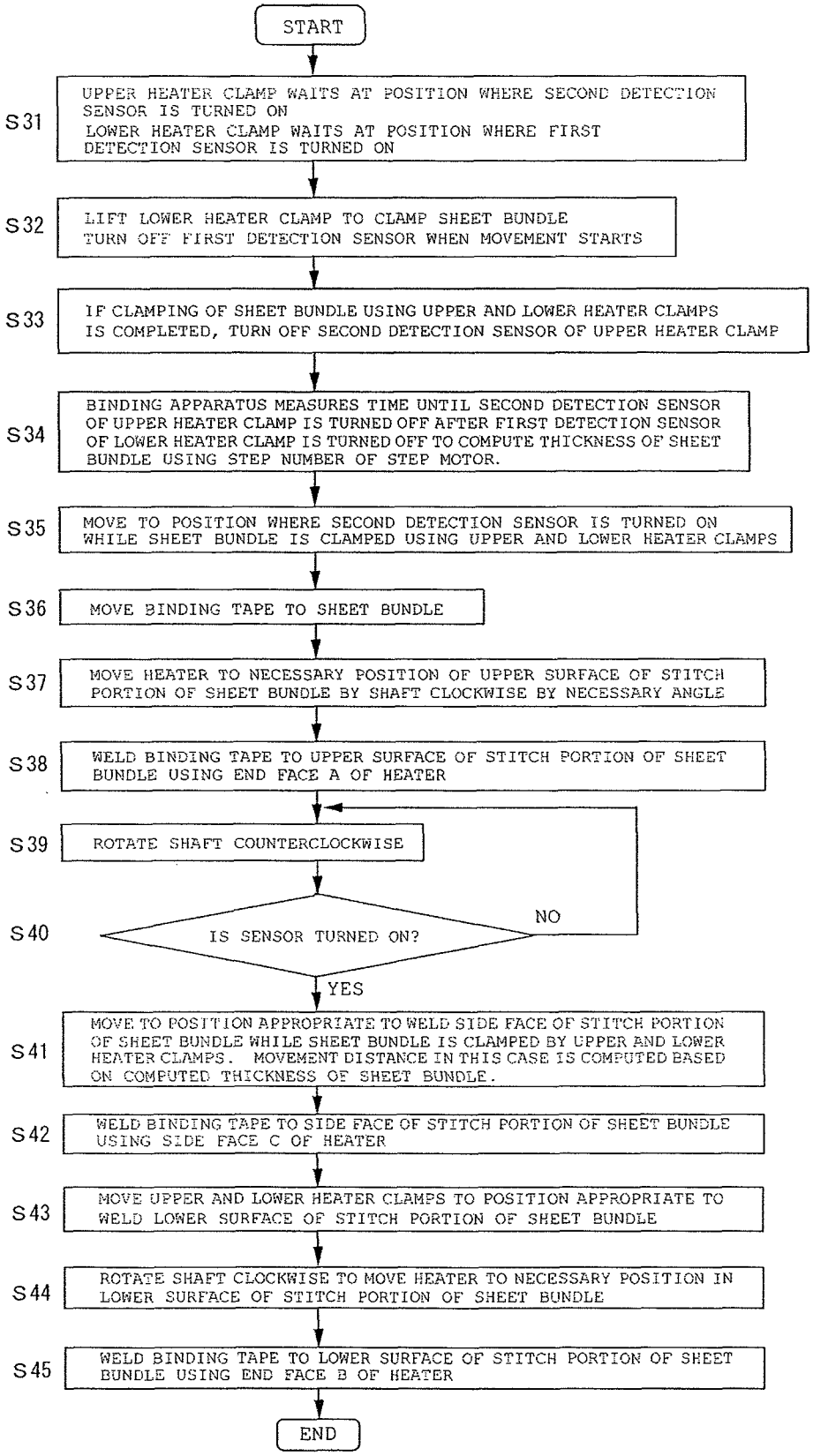
FIG. 27 is a flowchart illustrating the operation of the binding unit.

Next, the operation of the binding unit will be described with reference to FIG. 27. FIG. 27 is a flowchart illustrating the operation of the binding unit. When the sheet bundle 120 is sent to the sheet bundle shifting unit 500 by operating the binding unit 7, the upper heater clamp 502 waits at the position where the second detection sensor SW2 enters a detection state ON, and the lower heater clamp 501 waits at the position where the first detection sensor SW1 enters a detection state ON in step S31.

As the sheet bundle 120 is sent to the sheet bundle shifting unit 500, the sheet bundle 120 is loaded on the lower heater clamp 501. In this state, the lower heater clamp 501 is moved upwardly to clamp the sheet bundle 120. When the lower heater clamp 501 starts to move, the first detection sensor SW1 enters a non-detection state OFF in step S32.

As the lower heater clamp 501 is lifted, the sheet bundle 120 abuts on the upper heater clamp 502, and the upper heater clamp 502 is pressedly moved, the clamping of the sheet bundle 120 using the lower and upper heater clamps 501 and 502 is completed, and the second detection sensor SW2 enters a non-detection state OFF in step S33.

The time until the second detection sensor SW2 of the upper heater clamp 502 enters a non-detection state OFF after the first detection sensor SW1 of the lower heater clamp 501 enters a non-detection state OFF is measured using the step number of the step motor 514. As a result, a movement distance until the sheet bundle 120 is clamped using the lower and upper heater clamps 501 and 502 after the lower heater clamp 501 starts to move is detected, and the thickness of the sheet bundle 120 is computed based on the detected movement distance in step S34.

While the sheet bundle 120 is clamped using the lower and upper heater clamps 501 and 502, the sheet bundle 120 is lowered to the position where the second detection sensor SW2 enters a detection state ON in step S35.

The tape guide unit 115 is moved to make the binding tape 133 overlap on the upper surface of the stitch portion 120*a* of the sheet bundle 120 in step S36.

The heater 127 is moved forward by rotating the shaft 182 clockwise as necessary so that the end face A of the heater 127 is moved to the necessary position on the upper surface of the stitch portion 120*a* of the sheet bundle 120 and manually moved forward in step S37. In this forward movement position, the binding tape 133 is welded to the upper surface of the stitch portion 120*a* of the sheet bundle 120 using the end face A of the heater 127 in step S38. Then, the shaft 182 is rotated counterclockwise in step S39.

By rotating the shaft 182 counterclockwise, the heater 127 moves backward. At the backward movement position where the sensor 196 enters a detection state ON in step S40, the sheet bundle 120 is lifted to the position suitable for welding the side face of the stitch portion 120*a* of the sheet bundle 120 while the sheet bundle 120 is clamped using the lower and upper heater clamps 501 and 502. The movement distance in this case is computed based on the already computed thickness of the sheet bundle 120 in step S41.

Using the side face C of the heater 127, the binding tape 133 is welded to the side face of the stitch portion 120*a* of the sheet bundle 120 in step S42. The sheet bundle 120 is lifted to the position suitable for welding the lower surface of the stitch portion 120*a* of the sheet bundle 120 while the sheet bundle 120 is clamped using the lower and upper heater clamps 501 and 502. The movement distance in this case is computed based on the already computed thickness of the sheet bundle 120 in step S43.

By rotating the shaft 182 clockwise, the heater 127 is moved forward to the necessary position of the lower surface of the stitch portion 120*a* of the sheet bundle 120 in step S44. The binding tape 133 is welded to the lower surface of the stitch portion 120*a* of the sheet bundle 120 using the end face B of the heater 120 in step S45.

In this binding process, the sheet bundle 120 is clamped using the lower and upper heater clamps 501 and 502, and the binding tape 133 is overlapped on the upper surface of the stitch portion 120*a* of the sheet bundle 120 at the lower portion of the heater 127 of the forward movement position. In this state, the sheet bundle 120 is lifted so that the binding tape 133 abuts on the lower surface of the heater 127, and the binding tape 133 is welded to the upper surface of the stitch portion 120*a* of the sheet bundle 120 using the heater 127 in step S21 of FIG. 26. Then, the heater 127 is moved backward to the side face of the stitch portion 120*a* of the sheet bundle 120 in the straight line in step S22 of FIG. 26. The sheet bundle 120 is lifted while the sheet bundle 120 is clamped, and the binding tape 133 is welded to the side face of the stitch portion 120*a* of the sheet bundle 120 using the heater 127 in step S23 of FIG. 26. The sheet bundle 120 is further lifted to the position where the lower surface of the stitch portion 120*a* of the sheet bundle 120 is deviated from the face C of the heater 127 in step S24 of FIG. 26. The heater 127 is moved forward in a straight line, and the binding tape 133 is welded to the lower surface of the stitch portion 120*a* of the sheet bundle 120 so that the binding is completed.

In this manner, using a simple structure in which the sheet bundle 120 is vertically moved, and the heater 127 is moved in a straight line to the forward movement position and the backward movement position, ink blurring of the character printed on the sheet during the tape welding process of the sheet bundle 120 can be prevented and the binding quality can be improved. In addition, since the guide plate 86 guides horizontal movement of the heater 127, the heater 127 can be accurately moved and the movement structure can be simplified.

In addition, a movement distance until the sheet bundle 120 is clamped using the lower and upper heater clamps 501 and 502 after the lower heater clamp 501 starts to rise is detected. The thickness of the sheet bundle 120 is obtained based on the movement distance. By vertically lifting the sheet bundle 120 by a distance depending on the thickness of the sheet bundle 120, the sheet bundle 120 can be vertically moved depending on the actual thickness of the sheet bundle 120.

In addition, the tape guide unit 115 is moved by controlling the tape guide unit shifting unit 601, and the binding tape 133 supplied to the receiving position is received and held. The binding tape 133 is moved to the attaching position. At the attaching position, the binding tape 133 is welded to the upper surface of the stitch portion 120*a* of the sheet bundle 120 using the heater 127. After the welding, the binding tape 133 is recovered to the receiving position. Therefore, the tape guide unit 115 can be prevented from serving as an obstacle and the binding tape 133 to the stitch portion 120*a* of the sheet bundle 120 can be reliably welded.

(Second Embodiment of Binding Unit)

(Entire Configuration of Binding Unit)

Figure 28:
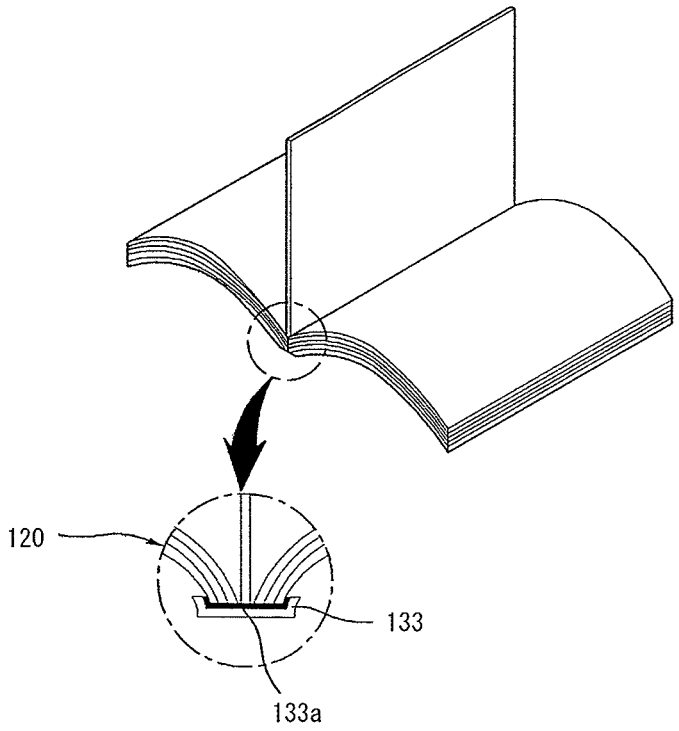
FIG. 28 is a diagram illustrating the sheet state bound using the binding unit.

Next, the second embodiment of the binding unit will be described. FIG. 28 is a diagram illustrating the sheet state bound using the binding unit. In the binding unit, as the adhesive 133*a* formed in one surface of the binding tape 133 is molten by applying heat of a predetermined temperature to the binding tape 133, the end face of the sheet bundle 120 is moved to the adhesive surface of the binding tape 133, and the sheet bundle 120 is bound by pressing the sheets.

Figure 29:
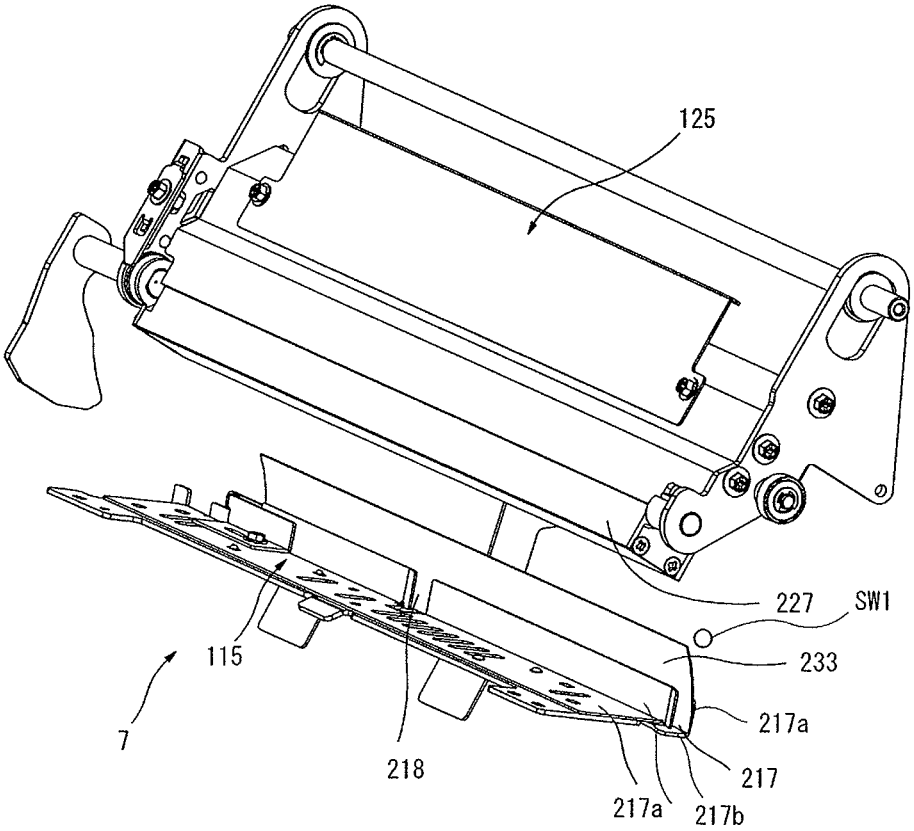
FIG. 29 is a perspective view illustrating the binding unit as seen from the front surface.
Figure 30:
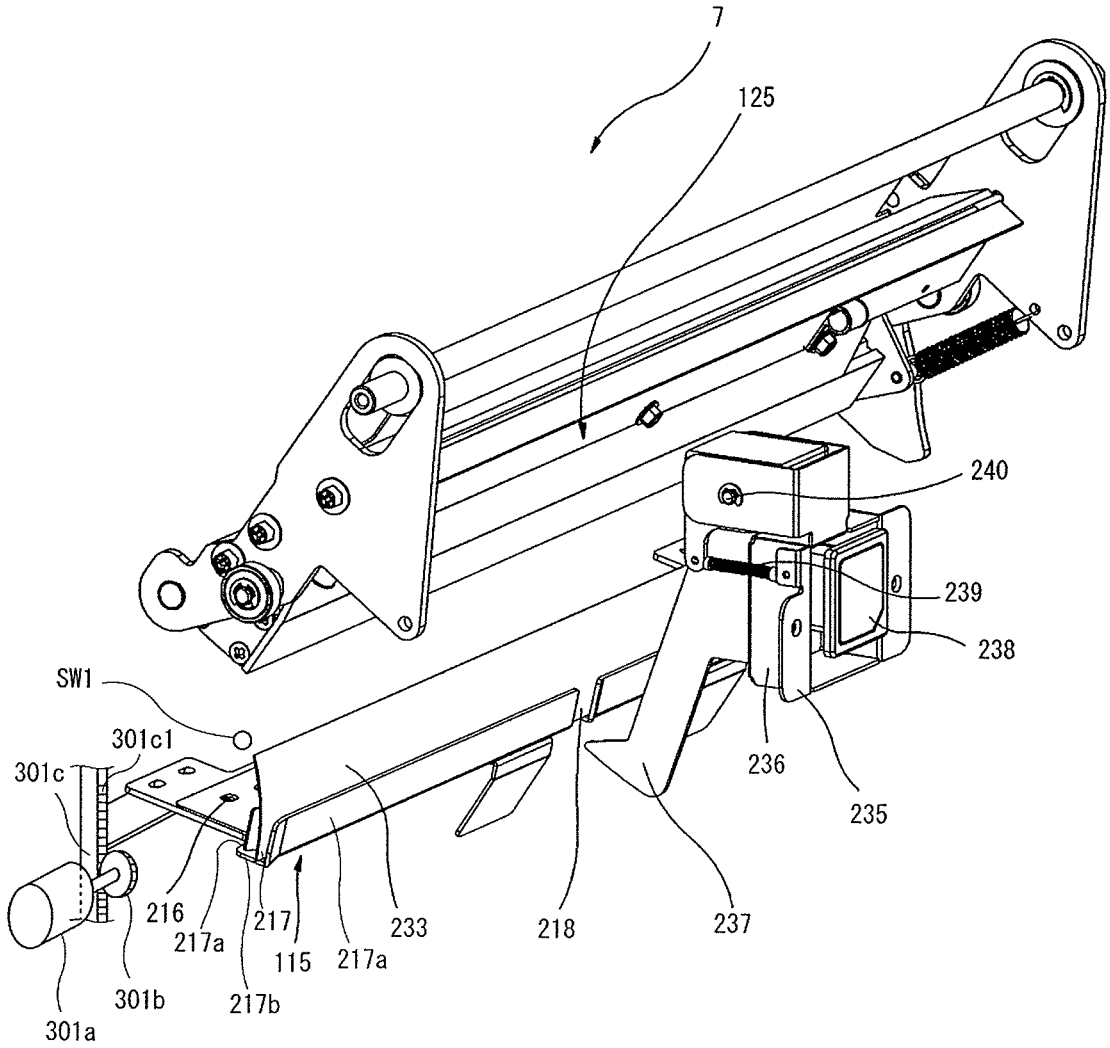
FIG. 30 is a perspective view illustrating the binding unit as seen from the rear surface.
Figure 31:
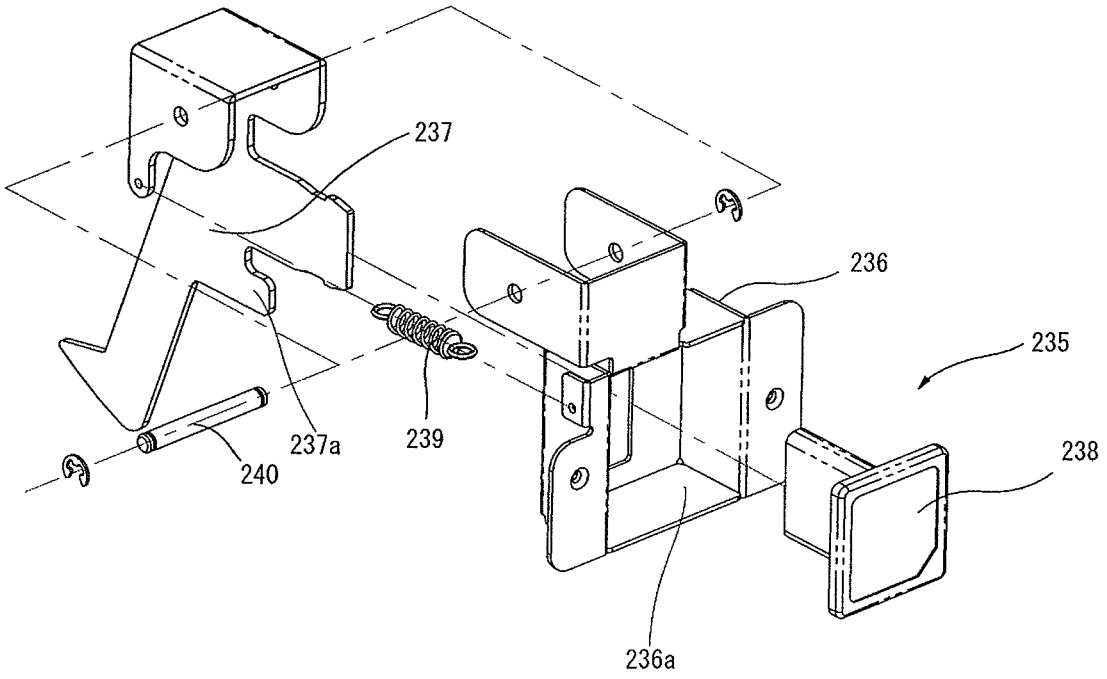
FIG. 31 is an exploded perspective view illustrating a push member of the tape guide unit.
Figure 32:
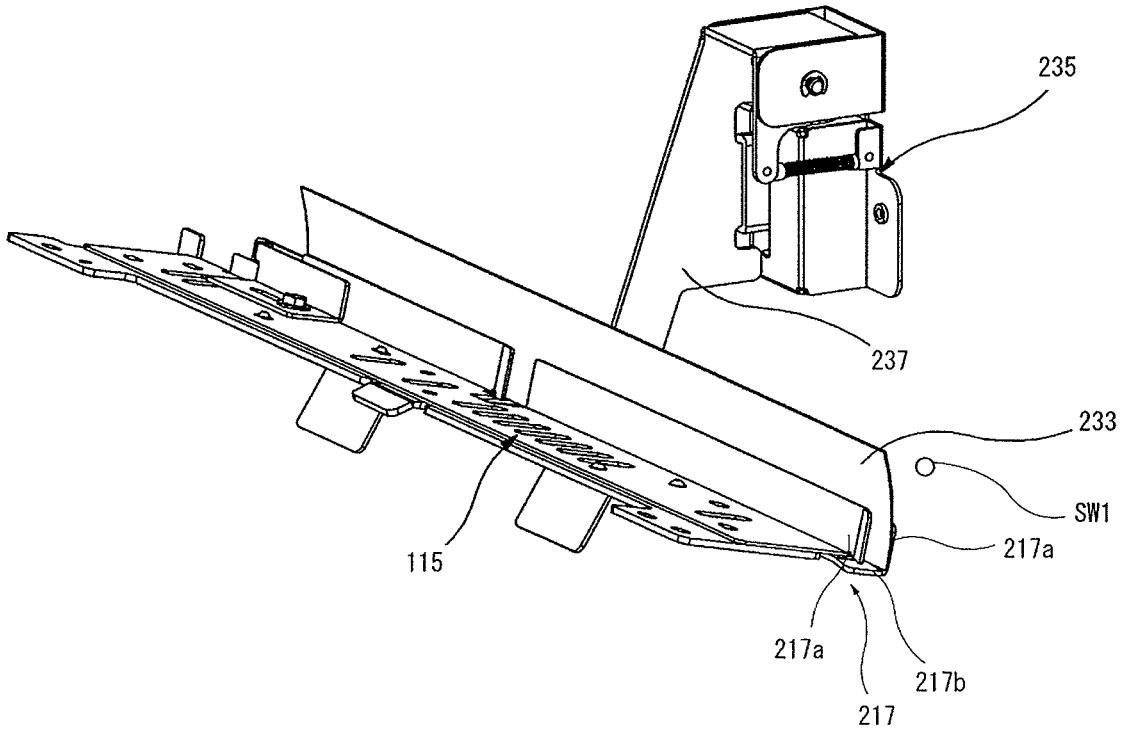
FIG. 32 is a perspective view illustrating a state that the binding tape is supplied to the tape guide unit as seen from the front surface.
Figure 33:
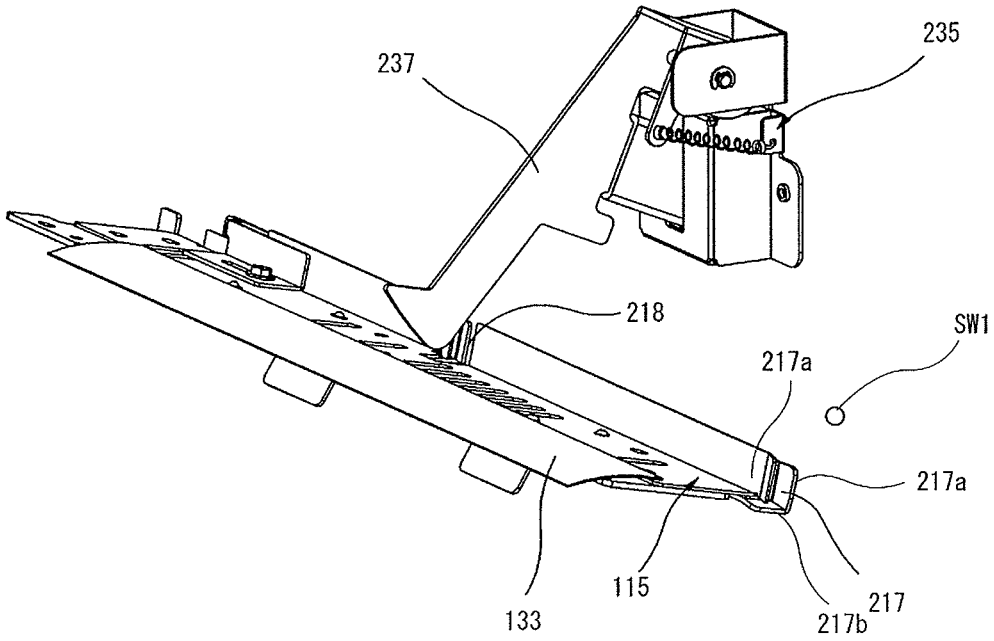
FIG. 33 is a perspective view illustrating a state that the binding tape supplied to the tape guide unit is deviated as seen from the front surface.
Figure 34:
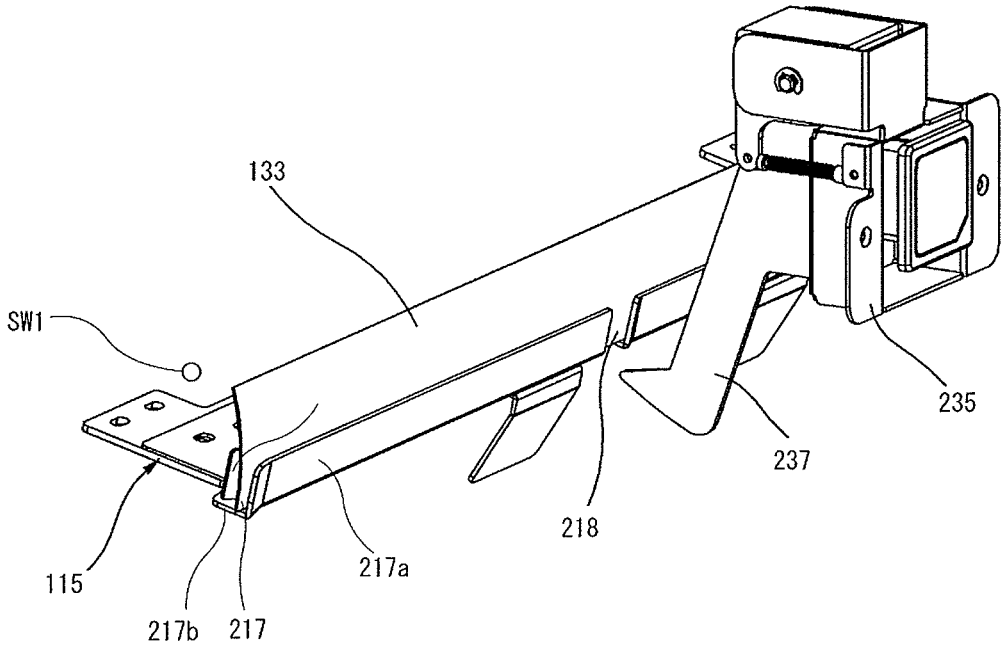
FIG. 34 is a perspective view illustrating a state that the binding tape is supplied to the tape guide unit as seen from the rear surface.
Figure 35:
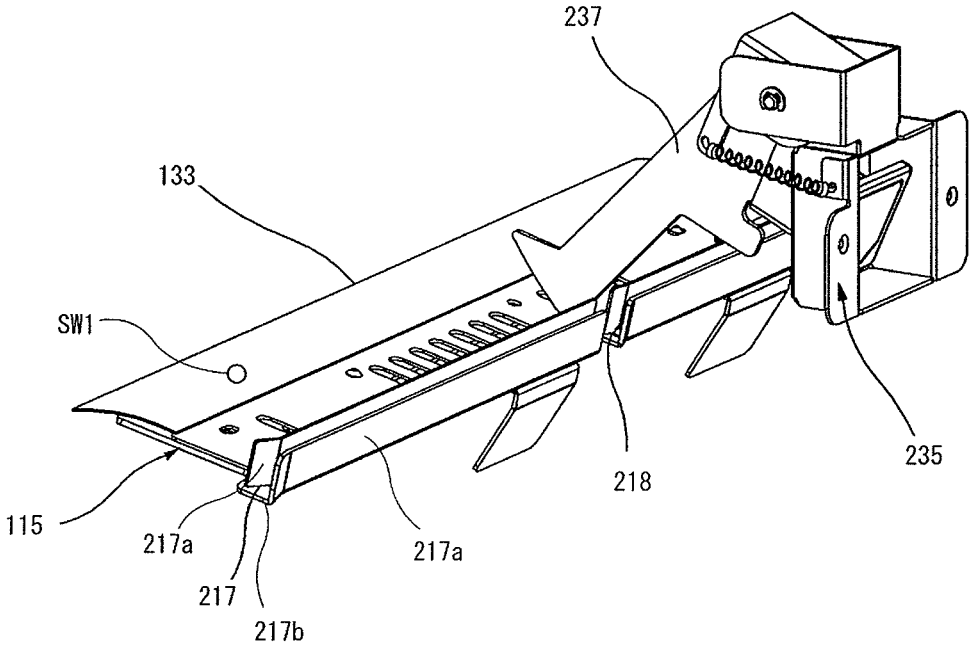
FIG. 35 is a perspective view illustrating a state that the binding tape supplied to the tape guide unit is deviated as seen from the rear surface.

FIGS. 29 to 35 illustrate a bonding unit, and FIG. 29 is a perspective view illustrating the binding unit as seen from the front surface. FIG. 30 is a perspective view illustrating the binding unit as seen from the rear side. FIG. 31 is an exploded perspective view illustrating the push member of the tape guide unit. FIG. 32 is a perspective view illustrating the state that the tape is supplied to the tape guide unit as seen from the front surface. FIG. 33 is a perspective view illustrating a state that the binding tape supplied to the tape guide unit is deviated as seen from the front surface. FIG. 34 is a perspective view illustrating a state that the binding tape is supplied to the tape guide unit as seen from the rear side. FIG. 35 is a perspective view illustrating the state that the binding tape supplied to the tape guide unit is removed as seen from the rear surface.

The binding unit 7 includes a tape guide unit 115 and a heater unit 125. The heater unit 125 provided in a heater 227 is configured such that the position and the angle of the heater 227 can be appropriately controlled. Meanwhile, a tape guide unit 215 provided under the heater unit 125 includes a tape transport path 217 having a frame 216, a pair of partition walls 217*a* provided in one side of the frame 216, and a lower plate 217*b*, and a notch portion 218 formed across the intermediate portion of the tape transport path. A push member 235 is provided in the portion making contact with the notch portion 218.

The push member 235 includes a casing 236 having a housing portion 236*a*, a rotation lever 237 fixed to the upper end of the casing 236 by interposing the support axis 240 such that a single end is rotatable, a button 238 which makes contact with a protrusion arm 237*a* protruding from the intermediate portion of the rotation lever 237 and is installed in the housing portion 236*a* of the casing 236, and a tension spring 239 fixed between the casing 236 and the rotation lever 237 to apply a tension force to the rotation lever 237.

The frame 216 having the tape transport path 217 and the notch portion 218 is configured such that the position shift and the angle modification can be made. Therefore, the tape transport path 217 appropriately approaches the position of the heater 227, and the adhesive surface of the binding tape 133 where a part thereof is exposed on the tape transport path 217 is pressed to the end surface of the sheet bundle 120 so that the binding tape 133 makes contact with the heater surface.

As the heat is applied to the binding tape 133 which makes contact with the heater 227, and the adhesive of the binding tape 133 becomes molten, the binding tape 133 is adhered to the end of the sheet bundle 120. Therefore, the tape guide unit 115 is conveyed to the original position, the binding tape 133 attached to a part of the sheet bundle 120 is completely bonded to the attaching position of the sheet bundle 120 such that remaining portion of the binding tape 133 is sequentially pressed by appropriately changing the position of the heater unit 125 and the sheet bundle 120 on the heater unit surface.

The sheet bundle 120 obtained by completing the binding after the binding tape 133 is completely bonded is discharged. Particularly, when a jam occurs in the process of supplying the binding tape 133 to the tape transport path 217, the rotation lever 237 is rotated with respect to the support axis 240 by pushing the button 238 of the push member 235 located in the rear side of the tape transport path 217. Therefore, the outer end of the rotation lever 237 is moved from the lower part to the upper part of the notch portion 218 crossing the tape transport path 217.

The binding tape 133 suffering from a jam on the tape transport path 217 is pushed up, forcibly removed from the tape transport path 217, and evacuated to the outer side while the outer end of the rotation lever 237 moves from the lower part to the upper part of the notch portion 218. Although only a single notch portion 218 is included in the tape transport path 217 according to the present embodiment, two or more notch portions 218 may be included, and a push member having a rotation lever may be provided such that the notch portions 218 of the tape transport path 217 can be moved forward and backward simultaneously.

In addition, the outer end of the rotation lever 237 is bent in an L-shape to stably raise the binding tape 133 without sliding. If the pushing pressure of the button 238 is released after the binding tape 133 suffering from a jam is removed, the rotation lever 237 is recovered to the original position by virtue of the forced recovery of the tension spring 239.

Figure 36:
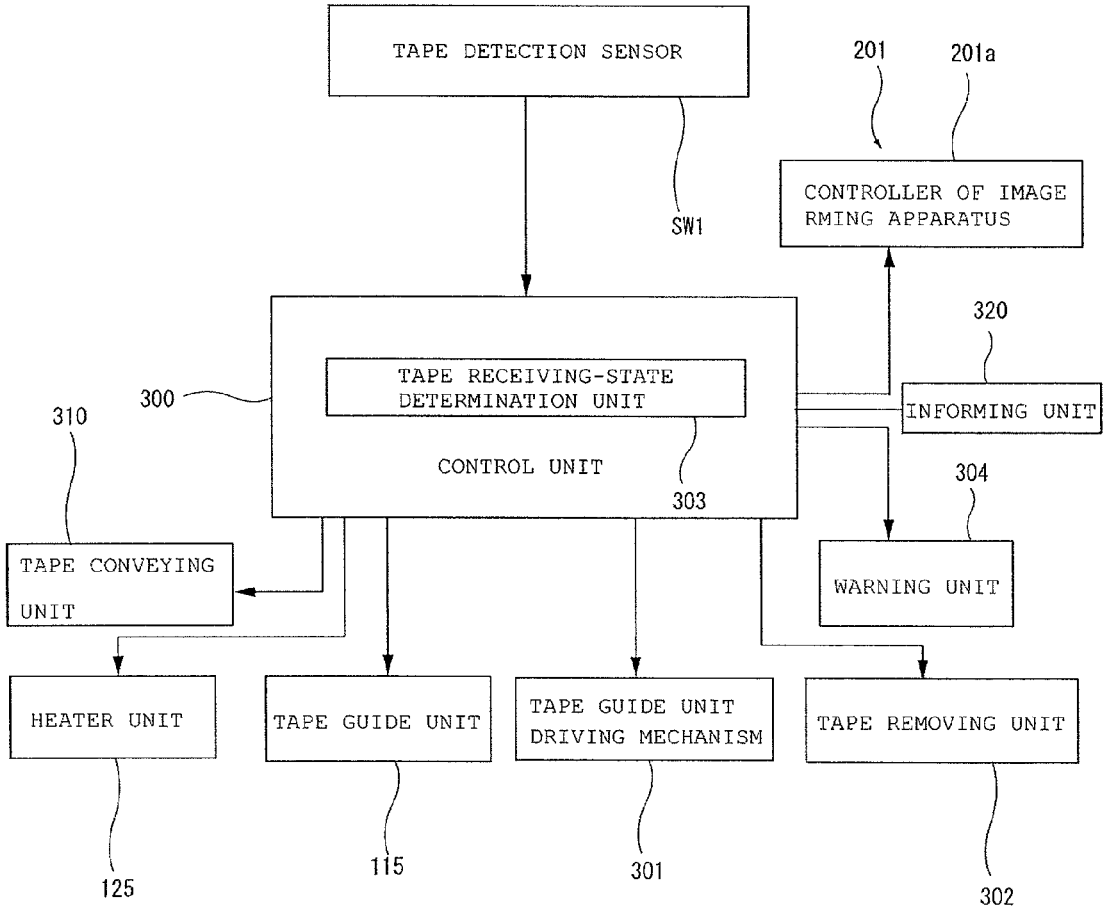
FIG. 36 is a control block diagram illustrating the binding unit.
Figure 37:
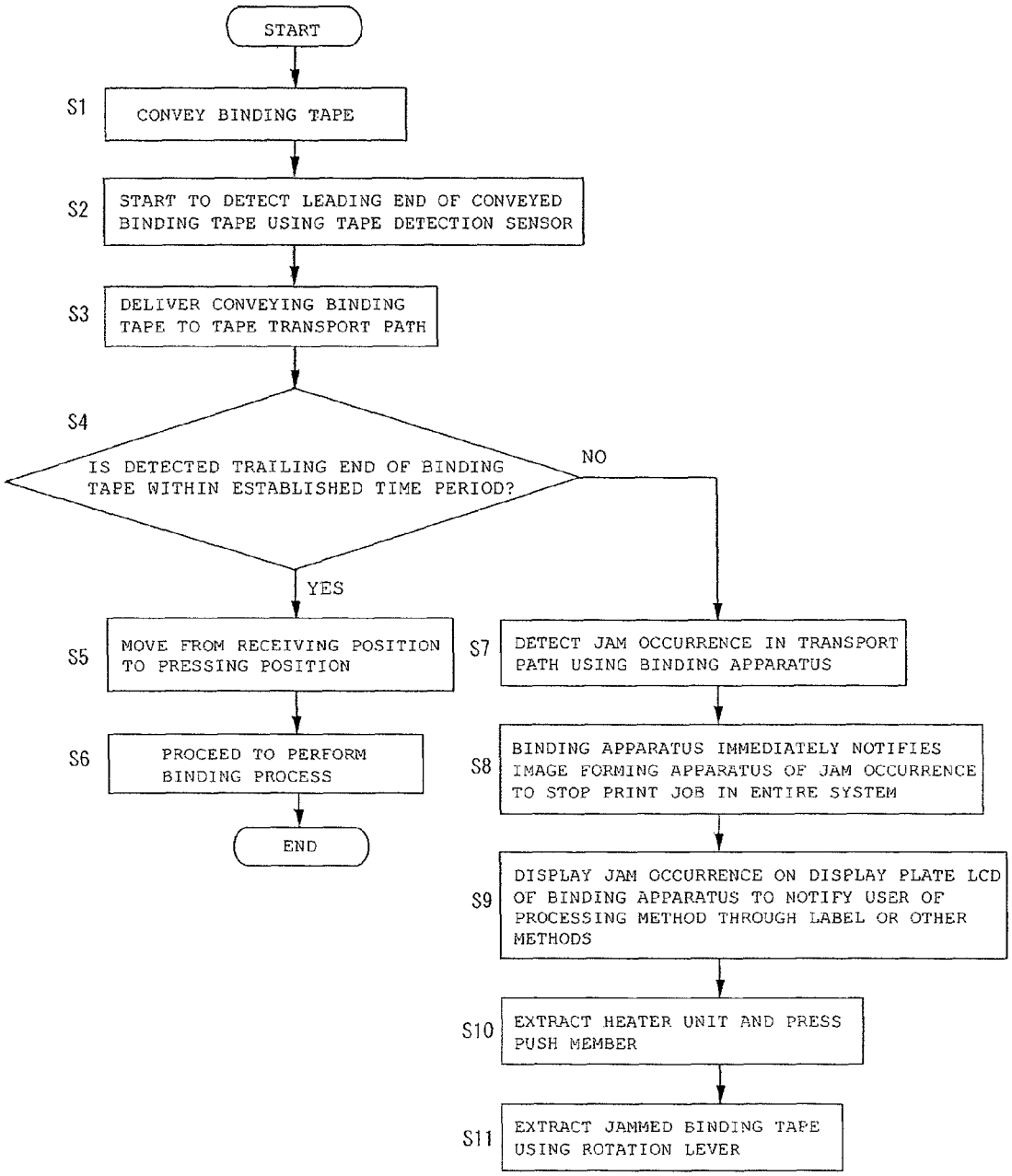
FIG. 37 is a flowchart illustrating the operation of the binding unit.

FIG. 36 is a control block diagram of the binding unit, and FIG. 37 is a flowchart illustrating the operation of the binding unit. The binding unit 7 has a control unit 300. The control unit 300 includes a microcomputer and may be integrated with or separated from the controller 201*a* of the image-forming apparatus 201. In addition, the binding unit 7 includes: a tape conveying unit 310 that conveys the binding tape 133; a heater unit 125 for pressing the end face of the sheet bundle 120 by applying heat of a predetermined temperature to the binding tape 133 to melt the adhesive 133*a* attached on one surface thereof; a tape guide unit 115 for receiving the supplied binding tape 133; a tape guide unit driving mechanism 301 that moves the tape guide unit 115 between the receiving position where the supplied binding tape 133 is received and the pressed bonding position of the heater unit 125; a tape removing unit 302 that removes the binding tape 133 inappropriately received by the tape guide unit 125 from the tape guide unit 125; a tape receiving-state determining unit 303 that determines the receiving state of the binding tape 133 in the tape guide unit 125; and a tape detection sensor SW1.

The tape conveying unit 310 includes, for example, a conveyance roller, a conveyance guide, and the like and conveys the binding tape 133 stocked in the housing portion with a predetermined length to supply it to the tape guide unit 115. The heater unit 125, the tape guide unit 115, and the tape removing unit 302 are configured as illustrated in FIGS. 29 to 35. The tape guide unit driving unit 301 is configured to move the tape guide unit 115 between the receiving position P1 for receiving the supplied binding tape 133 and the pressing position P2 of the heater unit 125 as illustrated in FIG. 1. For example, as illustrated in FIG. 30 (not illustrated in FIGS. 29 and 31 to 35), a support frame 301*c* having a lock 301*c*1 for meshing the driving motor 301*a*, the deceleration gear 301*b*, and the deceleration gear 301*b* with each other and the like is provided so that the frame 216 of the tape guide unit 115 is fixed to the support frame 301*c*.

The tape transport path 217 which includes the frame 216 and a pair of partition walls 217*a* and a lower plate 217*b* located in one side of the frame 216 is positioned in the receiving position P1, the binding tape 133 is received at the receiving position P1. As the driving motor 301*a* is rotated forward, the deceleration gear 301*b* is rotated so that the tape guide unit 115 is moved to the pressing position P2 through the support frame 301*c* by the lock 301*c*1 meshing with the deceleration gear 301*b*. As the sheets are bound at the pressing position P2, and the binding is completed, the driving gear 301*b* is rotated by rotating the driving motor 301*a* reversely, and the tape guide unit 115 is moved to the receiving position P1 through the support frame 301*c* by the lock 301*c*1 meshing with the deceleration gear 301*b*.

The tape receiving-state determining unit 303 includes a control unit 300. As illustrated in FIGS. 29 to 35, the tape detection sensor SW1 is arranged in one end side of the tape transport path 217. If the tape detection sensor SW1 detects the leading end of the binding tape 133 supplied from the one end side to the tape transport path 217, and the trailing end is detected with a defined time, it is determined that the receiving state is appropriate. If the tape detection unit SW1 detects the leading end of the binding tape 133, and a trailing end is not detected within a defined time, it is determined that the receiving state is inappropriate.

The control unit 300 controls the tape conveying unit 310 such that the binding tape 133 is conveyed and supplied to the tape guide unit 115 at a predetermined timing based on the determination that the receiving state is appropriate, and the conveyance of the binding tape 133 stops based on the determination that the receiving state is inappropriate to perform conveyance depending on the receiving state.

In addition, if the tape receiving-state determining unit 303 determines that the receiving state is appropriate, the control unit 300 controls the tape guide unit driving mechanism 301 such that the tape guide unit is moved from the receiving position P1 for receiving the binding tape 133 to the pressing position of the heater unit 125. If it is determined that the receiving state is inappropriate, the inappropriate receiving is notified by the informing unit 320, so that a manipulation for removing the binding tape 133 suffering from the inappropriate receiving from the tape guide unit 115 at the receiving position is instructed to the tape removing unit 302. The informing unit 320 includes a display device, a buzzer, and the like.

The tape removing unit 302 configured as described above includes a notch portion 218 formed to cross the tape transport path 217 and a push member 235 having a rotation lever 237 that can move forward and backward within the notch portion 218. If it is determined that the receiving state is inappropriate, the rotation lever 237 is operated so as to enter the notch portion 218 and remove the binding tape 133 from the tape transport path 217.

In addition, if it is determined that the receiving state is inappropriate, the control unit 300 performs control such that the warning unit 304 is operated to warn the inappropriate receiving state, and an error occurrence signal is transmitted to the controller 301*a* of the image-forming apparatus 201 for forming an image on the sheet of the sheet bundle 120. The warning unit 304 may issue the warning using the display unit such as a display plate (LCD) or a unit such as a buzzer. In addition, the controller 201*a* of the image-forming apparatus 201 receives the error occurrence signal and stops the operation of the image-forming apparatus 201 and the binding unit 7.

In this manner, if it is determined that the receiving state is inappropriate, the control unit 300 operates the warning unit 304 that warns the inappropriate receiving state to issue a notification of the inappropriate receiving state and stops the operation of the image-forming apparatus 201 for forming an image on the sheet of the sheet bundle 120 and operation of the binding unit 7. Therefore, it is possible to alleviate the adverse effect on the entire system.

(Operation of Binding Unit)

In the operation of the binding unit 7 according to the present embodiment, as illustrated in the flowchart of FIG. 37, the binding tape 133 is conveyed at a predetermined timing by driving the tape conveying unit 310 in step S1, and the binding tape 133 is supplied to the tape guide unit 115. The tape detection sensor SW1 starts to detect the leading end of the delivered binding tape 133 in step S2. The binding tape 133 is delivered to the tape transport path 217 of the tape guide unit 115 in step S3.

The tape detection sensor SW1 determines whether or not the trailing end of the binding tape 133 is detected within a defined time in step S4. If the trailing end of the binding tape 133 is detected, it is determined that the receiving state is appropriate so that the tape guide unit driving mechanism 301 is controlled to move the tape guide unit from the receiving position P1 for receiving the supplied binding tape 133 to the pressing position P2 of the heater unit 125 in step S5. Then, the binding process is performed in step S6.

In step S4, the tape detection sensor SW1 determines whether or not the trailing end of the binding tape 133 is detected within a defined time in step S4. If the trailing end of the binding tape 133 is not detected, it is determined that a jam occurs in the tape transport path 217 in step S7. The detection of the jam occurrence means a determination that the receiving state is inappropriate. A jam occurrence signal is immediately transmitted to the controller 201*a* of the image forming apparatus 201. The controller 201*a* stops the operation of the image forming apparatus 201 and the operation of the binding unit 7 based on the notification of the error occurrence signal from the binding unit 7 to stop the print job in the entire system in step S8. For example, if the image-forming apparatus 201 already performs a print job when the tape conveyance error occurs, the image-forming apparatus 201 stops the system after the sheet in the middle of printing is conveyed.

In addition, the jam occurrence is displayed on the display unit such as a display plate (LCD) serving as an informing unit 320 provided in the binding unit 7 to notify a user, and the manipulation for removing the jammed binding tape 133 is instructed by notifying a user of the processing method through a label or other methods in step S9. A user extracts the heater unit 125 and presses the push member 235 in step S10. The jammed binding tape 133 can be extracted using the rotation lever 237 and simply removed from the tape transport path 217 in step S10. In this manner, if it is determined that the receiving state is inappropriate, the binding tape 133 suffering from the inappropriate receiving at the receiving position P1 is removed from the tape guide unit 115. Therefore, it is possible to remove the binding tape 133 suffering from the inappropriate receiving without being affected by the heat when the inappropriate supplying such as a jam occurs in the binding tape 133.

The present invention is applied to a binding apparatus for post-processing and binding the sheets discharged from a digital output apparatus such as a printer, a copy machine, and a print machine. It is possible to obtain the binding strength with a simple structure without increasing the size of the binding apparatus.

What is claimed is:

1. A binding apparatus for binding sheets, comprising:

a notch-forming unit for forming a notch in a stitch portion side of a sheet bundle where a binding tape is welded to bind sheets and a binding unit for binding the sheets by welding the binding tape to a stitch portion of the sheet bundle obtained by bundling the sheets having the notch, the binding unit including a heater unit for pressing the stitch portion of the sheet bundle by melting an adhesive provided on a surface of the binding tape by applying heat at a predetermined temperature to the binding tape with a heater, a heater shifting unit for moving the heater in a straight line between a forward movement position and a backward movement position, a sheet bundle shifting unit comprising a lower heater clamp and an upper heater clamp for clamping the sheet bundle and which moves vertically while the sheet bundle is clamped and a control unit for controlling the sheet bundle shifting unit such that, when the sheet bundle is clamped by the lower and upper heater clamps, the binding tape is overlapped by an upper side of the stitch portion of the sheet bundle, wherein the notch-forming unit and the binding unit are provided on a sheet conveyance path of the binding apparatus, the binder tape is welded to an upper surface of the stitch portion of the sheet bundle using the heater by upwardly moving the sheet bundle to make the binding tape abut a lower surface of the heater, the heater shifting unit is controlled such that the heater is moved to a side face of the stitch portion of the sheet bundle in a straight line from the forward movement position to the backward movement position and in a straight line from the backward movement position to the forward movement position to weld the binding tape to a lower surface of the stitch portion of the sheet bundle, the sheet bundle shifting unit is controlled such that the sheet bundle is lifted, while being clamped, to weld the binding tape to a side face of the stitch portion of the sheet bundle using the heater and the sheet bundle is lifted to locate a lower portion of the side face of the stitch portion at an upper portion of the heater.

2. The binding apparatus according to claim 1, further comprising a movement distance detection unit for detecting a movement distance until the sheet bundle is clamped using the lower and upper heater clamps after the lower heater clamp starts to rise, wherein the control unit controls the sheet bundle shifting unit by obtaining a thickness of the sheet bundle based on the movement distance and the sheet bundle is moved based on the obtained thickness of the sheet bundle.

3. The binding apparatus according to claim 1, further comprising:

a tape guide unit for receiving and holding a supplied binding tape and a tape guide unit shifting mechanism for moving the tape guide unit between a receiving position and an attaching position, wherein the control unit controls the tape guide unit shifting mechanism to move the tape guide unit, supplied binding tape is received and held at the receiving position, the binding tape is welded to an upper surface of the stitch portion of the sheet bundle using the heater at the attaching position and the tape guide unit is recovered to the receiving position after binding tape is welded to the upper surface of the stitch portion of the sheet bundle.

4. The binding apparatus according to claim 1, further comprising a guide plate which abuts the upper surface of the heater to guide the movement of the heater.

5. A binding apparatus for binding sheets, comprising a binding unit for binding sheets by welding a binding tape to a stitch portion of a sheet bundle obtained by bundling sheets in a sheet conveyance path of the binding apparatus, the binding unit including: a heater unit for pressing the stitch portion of the sheet bundle by melting an adhesive provided on a surface of the binding tape by applying heat at a predetermined temperature to the binding tape with a heater; a heater shifting unit for moving the heater in a straight line between a forward movement position and a backward movement position; a sheet bundle shifting unit comprising a lower heater clamp and an upper heater clamp for clamping the sheet bundle and which moves vertically while the sheet bundle is clamped; and a control unit for controlling the sheet bundle shifting unit such that, when the sheet bundle is clamped by the lower and upper heater clamps, the binding tape is overlapped by an upper side of the stitch portion of the sheet bundle, wherein the binder tape is welded to an upper surface of the stitch portion of the sheet bundle using the heater by upwardly moving the sheet bundle to make the binding tape abut a lower surface of the heater, the heater shifting unit is controlled such that the heater is moved to a side face of the stitch portion of the sheet bundle in a straight line from the forward movement position to the backward movement position and in a straight line from the backward movement position to the forward movement position to weld the binding tape to a lower surface of the stitch portion of the sheet bundle, the sheet bundle shifting unit is controlled such that the sheet bundle is lifted, while being clamped, to weld the binding tape to a side face of the stitch portion of the sheet bundle using the heater and the sheet bundle is lifted to locate a lower portion of the side face of the stitch portion at an upper portion of the heater.

6. The binding apparatus according to claim 5, wherein the binding unit includes a heater unit that applies heat of a predetermined temperature to the binding tape to melt an adhesive attached on one surface and press an end face of the sheet bundle, a tape guide unit that receives the supplied binding tape, a tape guide unit driving mechanism that moves the tape guide unit between a receiving position where the supplied binding tape is received and a pressing position of the heater unit, a tape removing unit that removes the binding tape inappropriately received by the tape guide unit from the tape guide unit, an informing unit that notifies the inappropriate receiving and instructing a removal manipulation in the tape removing unit, a tape receiving-state determining unit that determines a receiving state of the binding tape in the tape guide unit, and a control unit that performs control such that, if the tape receiving-state determining unit determines that the receiving state is appropriate, the tape guide unit driving mechanism is controlled such that the tape guide unit is moved from a receiving position where the binding tape is received to a pressing position of the heater unit, and if the tape receiving-state determining unit determines that the receiving state is inappropriate, the informing unit notifies the inappropriate receiving to instruct a removal manipulation in the tape removing unit.

7. The binding apparatus according to claim 5, further comprising a movement distance detection unit for detecting a movement distance until the sheet bundle is clamped by the lower and upper heater clamps after the lower heater clamp starts to rise, wherein the control unit controls the sheet bundle shifting unit by obtaining the thickness of the sheet bundle based on the movement distance and the sheet bundle is moved based on the obtained thickness of the sheet bundle.

8. The binding apparatus according to claim 5, further comprising:

a tape guide unit for receiving and holding a supplied binding tape and a tape guide unit shifting mechanism for moving the tape guide unit between a receiving position and an attaching position, wherein the control unit controls the tape guide unit shifting mechanism to move the tape guide unit, supplied binding tape is received and held at the receiving position, the binding tape is welded to an upper surface of the stitch portion of the sheet bundle using the heater at the attaching position, and the tape guide unit recovers to the receiving position after the binding tape is welded to the upper surface of the stitch portion of the sheet bundle.

9. The binding apparatus according to claim 5, further comprising a guide plate which abuts an upper surface of the heater to guide the movement of the heater.

10. A binding apparatus for binding sheets, comprising:

a notch-forming unit for forming a notch in a stitch portion side of a sheet bundle where a binding tape is welded to bind sheets and a binding unit for binding the sheets by welding the binding tape to a stitch portion of the sheet bundle obtained by bundling the sheets having the notch, the binding unit including a heater unit for pressing the stitch portion of the sheet bundle by melting an adhesive provided on a surface of the binding tape by applying heat at a predetermined temperature to the binding tape with a heater, a tape guide unit for receiving supplied binding tape, a tape guide unit driving mechanism for moving the tape guide unit between a receiving position where the supplied binding tape is received and a pressing position of the heater unit, a tape removing unit for removing binding tape inappropriately received by the tape guide unit from the tape guide unit, an informing unit for notifying inappropriate receipt of the binding tape and instructing a removal manipulation in the tape receiving unit, a tape receiving-state determining unit for determining a receiving state of the binding tape in the tape guide unit and a control unit for controlling the tape guide unit driving mechanism to move the tape guide unit from a receiving position where the binding tape is received to a pressing position of the heater unit if the tape receiving-state determining unit determines that the receiving state is appropriate and, if the tape receiving-state determining unit determines that the receiving state is inappropriate, the informing unit notifies the inappropriate receipt and a removal manipulation is instructed in the tape removing unit.

11. The binding apparatus according to claim 10, further comprising a tape detection sensor for detecting supply of the binding tape, wherein the tape receiving-state determining unit determines that the receiving state is appropriate if the tape detection sensor detects a leading end of the binding tape and detects a trailing end within a defined time, and the tape receiving-state determining unit determines that the receiving state is inappropriate if the tape detection sensor detects a leading end of the binding tape and does not detect a trailing end within a defined time.

12. The binding apparatus according to claim 10, wherein the tape guide unit includes a tape transport path for holding the supplied binding tape, the tape removing unit includes a notch portion formed to cross the tape transport path and a push member having a rotation lever enabled to move forward and backward within the notch portion, and the rotation lever is operated to enter a gap within the notch portion to remove the binding tape from the tape transport path if it is determined that the receiving state is inappropriate.

13. The binding apparatus according to claim 10, wherein, if it is determined that the receiving state is inappropriate, the control unit performs a control such that if a warning unit warns that the receiving state is inappropriate, an error occurrence signal is transmitted to an image-forming apparatus that forms an image on the sheet of the sheet bundle and the image-forming apparatus receives the error occurrence signal and stops the operation of the image-forming apparatus and the binding apparatus.

14. The binding apparatus according to claim 10, further comprising a tape conveying unit for conveying the binding tape, wherein the control unit controls the tape conveying unit such that the binding tape is conveyed and supplied to the tape guide unit at a predetermined timing if it is determined that the receiving state is appropriate and conveyance of the binding tape stops if it is determined that the receiving state is inappropriate.

* * * * *